US008141726B2

(12) United States Patent
Forbes et al.

(10) Patent No.: US 8,141,726 B2
(45) Date of Patent: Mar. 27, 2012

(54) RAILROAD GONDOLA CAR STRUCTURE AND MECHANISM THEREFOR

(75) Inventors: James W. Forbes, Campbellville (CA); Marcus Thiesen, Hamilton (CA); Dave Keats, Brantford (CA)

(73) Assignee: National Steel Car Limited (CA)

( * ) Notice: Subject to any disclaimer, the term of this patent is extended or adjusted under 35 U.S.C. 154(b) by 0 days.

(21) Appl. No.: 12/780,741

(22) Filed: May 14, 2010

(65) Prior Publication Data

US 2010/0219148 A1 Sep. 2, 2010

Related U.S. Application Data

(62) Division of application No. 12/559,065, filed on Sep. 14, 2009.

(30) Foreign Application Priority Data

Sep. 11, 2009 (CA) ..... 2678447
Sep. 14, 2009 (CA) ..... 2678605

(51) Int. Cl.
*B61G 7/10* (2006.01)

(52) U.S. Cl. ..... 213/51; 213/50

(58) Field of Classification Search ..... 105/199.4, 105/406.1, 413, 414, 415, 420; 213/50, 51, 213/56, 60, 61, 75 R
See application file for complete search history.

(56) References Cited

U.S. PATENT DOCUMENTS 673,103 A * 4/1901 Williamson et al. ..... 105/248
763,186 A 6/1904 Johnson
1,421,439 A 7/1922 Finckh (Continued)

FOREIGN PATENT DOCUMENTS

CA 1082524 A1 7/2009

(Continued)

OTHER PUBLICATIONS

5 Photographs of Quebec Iron and Titanium (QIT) ore hopper car No. 556, dated Aug. 15, 2007.

(Continued)

*Primary Examiner* — Joe Morano, IV
*Assistant Examiner* — Jason C Smith
(74) *Attorney, Agent, or Firm* — Hahn Loeser & Parks LLP; Michael H. Minns

(57) ABSTRACT

A railroad gondola car has a hopper carried between two trucks. The hopper has convergent end and side slope sheets that feed a bottom discharge. The bottom discharge has a pair of longitudinal doors. The car has a very short draft installation that includes a removable coupler carrier bar, and the main shear plate has a removable draft gear installation cover. The rear draft stop extends longitudinally inboard past the truck center. The couple arrangement includes an AAR Type E shank with an AAR Type F coupler There is a machinery space above the end section shear plate. It is overhung by the slope sheet that is substantially unobstructed by any other primary structure. The pneumatic cylinder is mounted on an angle in this unobstructed machinery space, oriented longitudinally over the draft sill beneath the main drag link of the mechanical transmission, and above the main pivot of the driving input lever of the transmission. The main lever is bifurcated, and straddles the pneumatic cylinder. The lower portion of the side sheets lies laterally inboard of the stiffener web, while the upper portion lies laterally outboard of the stiffener web. The side slope sheet of the hopper meets the sidewall at the transition of the sidewall sheet from the inside-the-post to the outside-the-post condition.

27 Claims, 18 Drawing Sheets

U.S. PATENT DOCUMENTS

| | | | | | |
|---|---|---|---|---|---|
| 3,173,381 | A | | 3/1965 | Charles et al. | |
| 3,187,684 | A | | 6/1965 | Ortner | |
| 3,405,655 | A | * | 10/1968 | Dorey | 105/250 |
| 3,408,956 | A | | 11/1968 | Rebenok et al. | |
| 3,483,830 | A | | 12/1969 | McGrath | |
| 3,577,932 | A | | 5/1971 | Pulcrano et al. | |
| 3,596,609 | A | | 8/1971 | Ortner | |
| 3,611,947 | A | | 10/1971 | Nagy | |
| 3,654,873 | A | | 4/1972 | Floehr | |
| 3,710,730 | A | * | 1/1973 | Austgen et al. | 105/250 |
| 3,717,109 | A | | 2/1973 | Miller | |
| 3,717,110 | A | | 2/1973 | Miller | |
| 3,800,711 | A | | 4/1974 | Tuttle | |
| 3,807,316 | A | | 4/1974 | Miller | |
| 3,815,514 | A | | 6/1974 | Heap | |
| 3,818,842 | A | | 6/1974 | Heap | |
| 3,863,986 | A | | 2/1975 | Mentessi | |
| 3,872,796 | A | | 3/1975 | Adler et al. | |
| 3,878,794 | A | | 4/1975 | Adler | |
| 3,931,768 | A | | 1/1976 | Price et al. | |
| 3,949,681 | A | | 4/1976 | Miller | |
| 3,994,238 | A | | 11/1976 | Adler | |
| 4,106,813 | A | | 8/1978 | Goodbary | |
| 4,120,409 | A | | 10/1978 | vander Werff | |
| 4,194,450 | A | | 3/1980 | Miller | |
| 4,222,334 | A | | 9/1980 | Peterson | |
| 4,224,877 | A | * | 9/1980 | Stark et al. | 105/250 |
| 4,232,989 | A | | 11/1980 | Miller | |
| 4,246,849 | A | * | 1/1981 | Gramse | 105/251 |
| 4,250,814 | A | | 2/1981 | Stark et al. | |
| 4,252,068 | A | * | 2/1981 | Nolan | 105/420 |
| 4,348,962 | A | * | 9/1982 | Smith | 105/248 |
| 4,361,097 | A | * | 11/1982 | Jones et al. | 105/406.1 |
| 4,484,527 | A | * | 11/1984 | O'Hara | 105/247 |
| 4,542,701 | A | | 9/1985 | Fischer et al. | |
| 4,555,033 | A | * | 11/1985 | Miller | 213/51 |
| 4,573,594 | A | * | 3/1986 | Kunst et al. | 213/51 |
| RE32,189 | E | * | 6/1986 | Adler et al. | 105/377.07 |
| 4,601,244 | A | | 7/1986 | Fischer | |
| 4,637,320 | A | * | 1/1987 | Paton et al. | 105/406.1 |
| 4,740,130 | A | | 4/1988 | Prins | |
| 4,800,820 | A | * | 1/1989 | Tomaka | 105/406.1 |
| 4,843,974 | A | | 7/1989 | Ritter et al. | |
| 4,884,511 | A | | 12/1989 | Hallam et al. | |
| 4,893,568 | A | * | 1/1990 | Adams | 105/416 |
| 4,898,101 | A | * | 2/1990 | Harter | 105/247 |
| 5,063,858 | A | | 11/1991 | Dugge | |
| 5,086,709 | A | | 2/1992 | Fischer et al. | |
| 5,144,895 | A | | 9/1992 | Murray | |
| 5,163,372 | A | | 11/1992 | Galvan et al. | |
| 5,181,474 | A | * | 1/1993 | Miller | 105/355 |
| 5,249,531 | A | | 10/1993 | Taylor | |
| 5,261,333 | A | | 11/1993 | Miller | |
| 5,813,353 | A | * | 9/1998 | Sauter | 105/406.1 |
| 5,823,118 | A | | 10/1998 | Manstrom | |
| 6,604,469 | B1 | | 8/2003 | Galvan et al. | |
| 6,745,701 | B2 | | 6/2004 | Elder | |
| 7,080,598 | B2 | * | 7/2006 | Creighton et al. | 105/247 |
| 7,367,272 | B2 | | 5/2008 | Taylor | |
| 7,568,584 | B2 | * | 8/2009 | Brough et al. | 213/51 |
| 7,681,507 | B2 | * | 3/2010 | Herzog et al. | 105/286 |
| 7,735,426 | B2 | * | 6/2010 | Creighton et al. | 105/286 |
| 7,780,021 | B2 | * | 8/2010 | Forbes | 213/50 |
| 2010/0219148 | A1 | * | 9/2010 | Forbes et al. | 213/51 |
| 2010/0251922 | A1 | * | 10/2010 | Forbes et al. | 105/240 |

FOREIGN PATENT DOCUMENTS

| | | | |
|---|---|---|---|
| CN | 101486347 | | 7/2009 |
| EP | 0543279 | B1 | 5/1995 |
| EP | 1790547 | A1 | 5/2007 |
| EP | 1798103 | A1 | 6/2007 |
| GB | 1318571 | | 5/1973 |
| GB | 2013598 | | 8/1979 |

OTHER PUBLICATIONS

Drawing of QIT car dated Aug. 27, 2007.

2 Sheets of Details of End Structure of an Admitted Prior Art Grain Car of National Steel Car Showing End Post, Lateral Intermediate Stub Wall, Elephant Ears Arrangement and End Slope Sheet to Shear Plate Connection at least as early as Jan. 1, 2001.

Reproduction of Design Drawing of Dulth, Missabi & Iron Range (DM&IR) Open Topped Ore Hopper Car General Arrangement Drawing 8760 Drawn Apr. 8, 1950, (Quality Poor in Original), Showing Rear Draft Stops Extending Inboard of Truck Center.

Freight Cars: Hopper, Ore; Car Builders' Cyclopedia, 1937, pp. 313-320, 14th ed., Simmons-Boardman Publishing Corporation, New York, NY.

A.C.F. Covered and Open Top Hopper Cars; Car Builders' Cyclopedia, 1943, pp. 281-289, 16th ed., Simmons-Boardman Publishing Corporation, New York, NY.

Freight Cars: Hopper, Ore, Class HMA; Car Builders' Cyclopedia, 1957, pp. 265-272, 20th ed., Simmons-Boardman Publishing Corporation, New York, NY.

Freight Cars: Hopper, Ore, Class HMA; Car Builders' Cyclopedia, 1961, pp. 246-258, 21st ed., Simmons-Boardman Publishing Corporation, New York, NY.

Car and Locomotive Cyclopedia, 1966, 10 pages, 1st ed., Simmons-Boardman Publishing Corporation, New York, NY.

* cited by examiner

RAILROAD GONDOLA CAR STRUCTURE AND MECHANISM THEREFOR

This application is a divisional application of U.S. patent application Ser. No. 12/559,065 entitled "Railroad Gondola Car Structure and Mechanism Therefor," filed Sep. 14, 2009, which claims priority under 35 USC 119 to Canadian Patent Application Serial Number 2,678,447, entitled "Railroad Gondola Car Structure and Mechanism Therefor" filed Sep. 11, 2009, and Canadian Patent Application Serial Number 2,678,605, entitled "Railroad Gondola Car Structure and Mechanism Therefor" filed Sep. 14, 2009. U.S. patent application Ser. No. 12/559,065 is incorporated herein by reference.

FIELD OF THE INVENTION

This invention relates to the field of railroad freight cars, and, in particular to railroad gondola cars such as may employ bottom unloading gates or doors.

BACKGROUND

There are many kinds of railroad cars for carrying particulate material, be it sand or gravel aggregate, plastic pellets, grains, ores, potash, coal or other granular materials. Many of those cars have an upper opening, or accessway of some kind, by which the particulate is loaded, and a lower opening, or accessway, or gate, or door by which the particulate material exits the car under the influence of gravity. While the inlet opening need not necessarily have a movable gate, the outlet opening requires a governor of some kind that is movable between a closed position for retaining the lading while the lading is being transported, and an open position for releasing the lading at the destination. The terminology "flow through" or "flow through railroad car" or "center flow" car, or the like, may sometimes be used for cars of this nature where lading, typically particulate lading, is introduced at the top, and flows out at the bottom.

Discharge doors for gondola cars or other bottom dumping cars may tend to have certain desirable properties. First, to the extent possible it is usually desirable for the door opening to be large so that unloading may tend to be relatively fast, and for the sides of any unloading chute to be relatively steep so that the particulate will tend not to hang up on the slope. Further, to the extent that the door can be large and the slope sheets steep, the interior of the car may tend to have a greater lading volume for a given car length. Further still, any increase in lading achieved will tend to be at a relatively low height relative to Top of Rail (TOR) and so may tend to aid in maintaining a low center of gravity. A low center of gravity tends to yield a better riding car that is less prone to derailment, and perhaps less prone to cause as much wear or damage to tracks.

For a given length of car, hopper volume, and hence overall car volume, can be maximized by reducing the proportion of the length of the car occupied by the trucks, and occupied by the door opening drive mechanism. Furthermore, where the lading to be carried by the car is of greater than usual density, it may often be helpful for the truck center length to be relatively short such that the length of the span between the trucks is smaller, and the weight of the structure may be correspondingly decreased relative to the maximum permissible gross weight on rail for the car. In some instances, as with iron ore or other high density lading, that truck center distance may be very short.

It may also be that in some circumstances ore cars are used in quasi-permanent sets that form a unit train. The unit train may tend to follow a single route for substantially its entire operational service life. In the case of an ore car, that operational route may be from a mine or concentrator facility, at which the cars receive the lading; to a discharge facility, whether a mill or a break of bulk terminal at a port. In these circumstances the line may be owned by the mine or mill, and the cars may not necessarily be used for interchange service. To the extent that they are not used for interchange service they may not necessarily comply with all AAR standards. The cars may have short, possibly non-standard draft sills, draft gear, and couplers, or a combination thereof.

The cars may have tightly limited space envelopes over the end shear plates, and yet these spaces may nonetheless be intended to accommodate, for example, the brake reservoir and pneumatic gear for operating the gondola discharge doors.

SUMMARY OF THE INVENTION

In an aspect of the invention there is a railroad hopper car. It has at least one hopper having a bottom discharge, the bottom discharge including a door movable between a closed position for retaining lading and an open position for permitting egress of lading. The hopper is carried on spaced apart railroad cars trucks for rolling motion along railroad tracks in a lengthwise direction of the car. The hopper has at least a first end slope sheet inclined downwardly in the lengthwise direction toward the door. There is a linkage connected to the door. The linkage is oriented lengthwise with respect to the car. A drive is connected to the linkage. The drive is operable to move the linkage and thereby to urge the door to a closed position. The linkage is movable from a first position corresponding to the open position of the door to a second position corresponding to the closed position of the door. The linkage includes at least a drag link. When the linkage moves from the first to the second position one of (a) the overall motion from the first to the second position includes displacement of the drag link in a direction having a predominant component of motion parallel to the first end slope sheet; and (b) the motion of the drag link is at least instantaneously parallel to the first end slope sheet.

In another feature of that aspect of the invention the linkage includes a first pivot arm pivotally connected to a datum structure at a first pivot connection. The drive is also mounted to the datum structure. The linkage includes a second pivot arm pivotally connected to the datum structure at a second pivot connection. The second pivot arm has the door mounted thereto. The first pivot arm has a second connection distant from the first pivot connection. The second pivot arm has a second connection distant from the second pivot connection. A mechanical transmission is mounted between the second connection of the second pivot arm and the second connection of the first pivot arm. The mechanical transmission includes the drag link. The drive is connected to move the first pivot arm, and, in moving from the first position to the second position, each position of the first pivot arm being associated with a unique position of the drag link. In a further feature, the linkage includes left and right hand first pivot arms pivotally connected to a datum structure at respective first pivot connections, the respective first pivot connections being co-axial. The linkage includes left and right hand second pivot arms pivotally connected to the datum structure at respective second pivot connection. The door is a left hand door of a pair of co-operable right and left hand doors, the left hand door being mounted to the left hand second pivot arm and the right hand door being mounted to the right hand second pivot arm. Each first pivot arm has a respective second connection distant from its respective first pivot connection, the respective second connections being pivot connections and being mutually co-axial. Each second pivot arm has a respective second connection distant from the respective second pivot connection. A mechanical transmission is mounted between the respective second connections of the second pivot arms and the respective second connections of the first pivot arms. The drag link is a left hand drag link, and the mechanical transmission includes a mated parallel right hand drag link. The left and right hand drag links each have a first end mounted to one of the respective second connections of the first pivot arms. The left and right hand drag links have second ends yoked together distantly from the first ends. The transmission member includes left and right hand slave links extending between and connecting the second ends of the drag links to the second connections of the second pivot arms respectively.

In still another feature, the linkage includes left and right hand first pivot arms pivotally connected to a datum structure at respective first pivot connections, the respective first pivot connections being co-axial. The linkage includes left and right hand second pivot arms pivotally connected to the datum structure at respective second pivot connection. The door is a left hand door of a pair of co-operable right and left hand doors, the left hand door being mounted to the left hand second pivot arm and the right hand door being mounted to the right hand second pivot arm. Each first pivot arm has a respective second connection distant from its respective first pivot connection, the respective second connections being pivot connections and being mutually co-axial. The left and right hand pivot arms co-operate to define a bifurcated lever straddling the drive. In yet another feature, the drive includes an actuating cylinder having an axially reciprocating member, the axially reciprocating member being inclined relative to horizontal. In still another feature the drag link lies between the actuating cylinder and the first end slope sheet of the hopper. In another feature the railroad hopper car includes a first end section, the first end section includes a draft sill and a substantially horizontal shear plate mounted over the draft sill, the drive includes an actuating cylinder having an axis of reciprocation lying in a central vertical-lengthwise plane of the car, the actuating cylinder is mounted above the shear plate, the first end slope sheet at least partially overhangs the actuating cylinder; and the drag link is located between the actuating cylinder and the first slope sheet.

In another aspect of the invention there is a railroad hopper car. It has at least one hopper having a bottom discharge, the bottom discharge including a gate movable between a closed position for retaining lading and an open position for permitting egress of lading. The car includes structure by which the hopper is carried on spaced apart railroad cars trucks for rolling motion along railroad tracks in a lengthwise direction of the car. A door operating linkage is connected to the gate, the door operating linkage being oriented lengthwise with respect to the car. An actuating cylinder connected to drive the door operating linkage, the actuating cylinder also being oriented to act lengthwise with respect to the car, the actuating cylinder having an axis of reciprocation. The axis of reciprocation being tilted such that displacement of the actuating cylinder includes a vertical component of motion.

In another feature of that aspect of the invention, the hopper car includes an end section mounted over one of the trucks, the end section includes a substantially horizontal shear plate, and the actuating cylinder is mounted on a pedestal mounted to the shear plate, the pedestal including an inclined mounting for the cylinder. In a further feature, the railroad hopper car has a longitudinal-vertical central plane, and the axis or reciprocation lies in the longitudinal-vertical plane. In a still further feature, the hopper includes at least a first end slope sheet extending longitudinally and being inclined longitudinally inboard and downwardly toward the gate, and at least part of the actuating cylinder is overhung by at least part of the first end slope sheet. In a yet further feature, the hopper car includes an end section having a substantially horizontal shear plate mounted over a draft sill. The hopper includes a first end slope sheet, the first end slope sheet at least partially overhanging the horizontal shear plate. The actuating cylinder is mounted above the shear plate, centrally aligned over the draft sill. The actuating cylinder is at least partially overhung by the first end slope sheet. In still yet anther further feature the first slope sheet is substantially planar and has a first angle of inclination relative to horizontal. The actuating cylinder is inclined longitudinally inboard downwardly, and is inclined at a second angle. The second angle lies between horizontal and the first angle. In yet another feature the car has an underframe and the door operating linkage includes a first linkage component, a second linkage component, a third linkage component, and a fourth linkage component. The first linkage component is a reference datum component and includes structure immovable relative to the underframe. The second linkage component is a first pivot linkage mounted to the first linkage component at a main pivot connection, the first pivot linkage being a first pivot arm constrained to pivot on an axis of rotation oriented horizontally crosswise relative to the underframe. The fourth linkage component is a second pivot linkage pivotally mounted to the first linkage component and includes at least the gate. The third linkage component includes a drag link element connected to the first pivot arm, the drag link element having at least a first pivotal attachment to at least a portion of the fourth linkage component, whereby input motion of the second linkage component uniquely determines position and motion of the third and fourth linkage components relative to the first linkage component. Motion of the second linkage component is driven by the actuator. In still another feature the main pivot connection of the first pivot arm to the first linkage component is located lower than the actuating cylinder. In yet still another feature, the drag link element is connected to the first pivot arm at a distal pivot connection relative to the main pivot connection, and, when the gate is in the closed position and the car is viewed in side view, the actuating cylinder is located between the main pivot connection and the distal pivot connection.

In another aspect there is a railroad hopper car. It has at least one hopper having a bottom discharge, the bottom discharge including a gate movable between a closed position for retaining lading and an open position for permitting egress of lading. It has first and second end sections to which the hopper is mounted, the first and second end sections being mounted to respective first and second railroad car trucks for rolling motion along railroad tracks in a lengthwise direction of the car. There is a door operating linkage connected to the gate, the door operating linkage being oriented lengthwise with respect to the car and connected. An actuating cylinder is connected to drive the door operating linkage. The actuating cylinder is also oriented to act in a lengthwise extending plane with respect to the car. The actuating cylinder has an axis of reciprocation. The door operating linkage includes a first pivot arm pivotally mounted to the first end section at a first pivot connection. There is a mechanical transmission connected between the first pivot arm and the gate. The mechanical transmission includes at least a drag link movably connected to the first pivot arm at a location distant from the first pivot connection. The first pivot connection is lower than the actuating cylinder as seen when viewing the first end section in side view.

In another feature of that aspect of the invention, when the gate is in the closed position and the car is viewed in side view, the actuating cylinder is located between the main pivot connection and the distal pivot connection. In still another feature, the actuating cylinder drives an intermediate lever that is connected to drive the first pivot arm.

In another aspect of the invention there is a railroad hopper car. It has a hopper carried between a pair of trucks, the hopper having first and second upstanding sidewalls running lengthwise therealong. The hopper has a lower discharge and convergent slope sheets giving onto the discharge. The railroad car has a side sill and a top chord. The first upstanding sidewall extends from the side sill to the top chord. The first upstanding sidewall has a predominantly upwardly running sidewall stiffener mounted thereto. The sidewall stiffener is located at a longitudinal station intermediate the trucks. The first upstanding sidewall has a first region, the first region being a lower region thereof. The first upstanding sidewall has a second region. The second region is an upper region thereof. The sidewall stiffener has a first portion, the first portion being a lower portion thereof. The first portion is mounted to the first region of the first upstanding sidewall. The sidewall stiffener has a second portion, the second portion being an upper portion thereof. The second portion is mounted to the second region of the upstanding sidewall. The first portion of the first upstanding sidewall stiffener is laterally outboard of the first region of the first upstanding sidewall. The second portion of the sidewall stiffener is laterally inboard of the second region of the first upstanding sidewall. The sidewall has a continuous section between the first and second regions thereof. The sidewall stiffener has web continuity between the first and second portions thereof.

In a feature of that aspect of the invention, the first and second portions of the sidewall stiffener are substantially co-planar, and are substantially vertically aligned when seen in a sectional view looking along the car. In another feature, the first upstanding sidewall has a third region intermediate the first and second regions. The third region includes a side sheet transition portion passing across the sidewall stiffener from an inboard margin thereof to an outboard margin thereof, and the stiffener has vertical web continuity through the transition portion. In another feature, the first upstanding sidewall has a third region intermediate the first and second regions. The third region includes a side sheet transition portion passing across the sidewall stiffener from an inboard margin thereof to an outboard margin thereof. The hopper includes first and second sloped side sheets. The first sloped side sheet meets the first sidewall at the transition portion. In another feature, the first sidewall has an overall height from the side sill to the top chord, L, and the transition is located a distance above the side sill that is in the range of ¼ to ⅔ L. In a still further feature the first sidewall has an overall height from the side sill to the top chord, L, and the first sloped sheet meets the transition at a height that is in the range of ¼ to ⅔ L above the side sill.

In a further aspect of the invention there is a railroad hopper car. It has at least one hopper having a bottom discharge, the bottom discharge having a bottom discharge governor movable between a closed position for retaining lading and an open position for permitting egress of lading. The car has structure by which the hopper is carried on spaced apart railroad cars trucks for rolling motion along railroad tracks in a lengthwise direction of the car. The hopper has a door operating linkage oriented lengthwise with respect to the car. There is an actuating cylinder also oriented to act in a lengthwise extending plane with respect to the car, the actuating cylinder being connected to drive the door operating linkage. The door operating linkage includes a pair of first and second linkage members co-operably mounted to either transverse side of the actuating cylinder, whereby the actuating cylinder is bracketed by the linkage members.

In another feature of that aspect of the invention, the car has an underframe and the linkage is a closed loop bar linkage in which there is a first linkage component, a second linkage component, a third linkage component, and a fourth linkage component. The first linkage component is a reference datum component and includes structure immovable relative to the underframe. The second linkage component is a first pivot linkage mounted to the first linkage component at a main pivot connection, and which includes the first and second linkage members, the first and second linkage members being a matched pair of left and right hand pivot arms constrained to pivot on a common axis of rotation relative to the underframe. The fourth linkage component is a second pivot linkage pivotally mounted to the first linkage component and which includes at least one pivotally mounted door assembly defining the bottom discharge governor. The third linkage component includes a drag link element having at least a first pivotal attachment to at least a portion of the fourth linkage component, whereby input motion of the second linkage component uniquely determines position and motion of the third and fourth linkage components relative to the first linkage component. Motion of the second linkage component is driven by the actuator.

In another feature the hopper includes a hopper end slope sheet. The end slope sheet extends substantially in a plane inclined downwardly and lengthwise inwardly toward the bottom discharge. Displacement of the third linkage component associated with motion of the door assembly between the open position is predominantly in a direction generally parallel to the end slope sheet. In another feature the hopper includes a hopper end slope sheet. The end slope sheet extends substantially in a plane inclined downwardly and lengthwise inwardly toward the bottom discharge. During at least an instantaneous portion of motion of the third linkage component while the door assembly is in a position between the open position and the closed position the third linkage component moves parallel to the end slope sheet. In still another feature the third linkage component includes at least a first element and a second element mounted thereto. The first element is pivotally mounted to the first linkage component, and is constrained to move in a lengthwise-vertical plane relative to the first linkage component. The second element has a first connection to the first component the first connection being a pivot connection. The second element has a second connection to the fourth linkage component, the second connection having at least one degree of freedom of motion. The second element is constrained always to be coplanar with the first connection, the second connection, and the main pivot connection. In yet still another feature, the bottom discharge governor includes a door. The actuating cylinder is connected to drive the door operating linkage through a lever assembly. The lever assembly has an overcenter lock that is operable to prevent release of the bottom gate to the open position when the actuating cylinder is inactive. In yet a further feature, motion of the first pivot linkage occurs in a longitudinal-vertical plane. The second pivot linkage moves in a plane generally crosswise to the longitudinal-vertical plane. In still a further feature the main pivot connection is beneath the actuating cylinder when the hopper car is seen in side view. In again another feature one of (a) the main pivot is beneath the drag link element; and (b) the actuating cylinder is between the main pivot and the drag link element. In a yet still further feature, the hopper includes at least a first end slope sheet, and the bottom discharge governor includes a door. The first end slope sheet is inclined longitudinally downwardly and inboard toward the door. The drag link element is inclined on a slope predominantly parallel to, and adjacent to, the first end slope sheet. The actuating cylinder is oriented along the lengthwise direction, and is also tilted longitudinally downwardly and inwardly toward the door.

In another aspect of the invention there is a railroad hopper car. It has at least one hopper carried by railroad car trucks for motion in a lengthwise direction of the car along railroad tracks. The hopper has a bottom discharge. The bottom discharge has a door movable between a closed position for retaining lading and an open position for permitting egress of lading. A mechanical transmission is connected to the door. The mechanical transmission is oriented lengthwise with respect to the car. A door actuator is connected to the mechanical transmission and is operable to urge the door from the open position toward the closed position, the door actuator being oriented to reciprocate in a first direction. The hopper car has a first lock operable to prevent movement of the door from the closed position to the open position when the door actuator is inactive. The hopper car has a second lock operable to prevent movement of the door from the closed position to the open position when the door actuator is inactive if the first lock should fail. The second lock is movable between an engaged position in which it prevents movement of the door to the open position thereof. In moving between the engaged and disengaged positions, the second lock has a displacement that is predominantly crosswise to the first direction of the reciprocation of the door actuator.

In another feature of that aspect of the invention, the car has a central lengthwise-vertical plane, the door actuator is positioned to reciprocate in the central lengthwise-vertical plane, and the second lock is movable between the engaged and disengaged positions in motion predominantly transverse to the central lengthwise-vertical plane. In another feature, the second lock is mounted on a hinge and pivots in a circumferential direction between the engaged and disengaged positions. In still another feature the second lock is mounted on a hinge, the hinge has an axis lying parallel to the lengthwise-vertical plane, and the second lock pivots circumferentially between the engaged and disengaged positions. In another feature, the second lock is biased toward the engaged position. In still another feature, the second lock is biased toward the engaged position. In yet another feature the apparatus is one in which one of: (a) the second lock has a cam and the actuator has a mating cam follower; and (b) the second lock has a cam follower and the actuator has a mating cam. The cam and cam follower are co-operable, and are oriented to deflect the second lock away from the engaged position as the door moves from the open position to the closed position thereof.

In another aspect of the invention, there is a lock mechanism for a door actuating transmission of a railroad gondola car, the door actuating transmission including a reciprocating actuating cylinder mounted to a datum structure, the cylinder being movable forward and backward in an axial direction. The lock mechanism has a body having a first fitting, a second fitting and a third fitting. The first fitting is a mounting by which to connect the lock mechanism to the datum structure. The second fitting is one of (a) a cam for co-operation with a member of the door actuating transmission, that member being a cam follower; and (b) a cam follower for co-operation with a member of the door actuating transmission, that member being a cam. The third fitting includes an abutment for co-operation with a mating fitting of the door actuating transmission. The third fitting is movable between a first position and a second position, in the first position the abutment being presented to obstruct motion of the mating fitting of the door actuating transmission and thereby to prevent the door from moving to an open position thereof. The second fitting is movable between a first position and a second position, in the first position thereof the second fitting being positioned to intercept the member of the door actuating transmission and to be deflected away from the first position toward the second position thereby. The first fitting has a first degree of freedom of motion permitting the first and second fittings to move between their respective first and second positions. The degree of freedom constrains the third fitting to motion predominantly crosswise to the axial direction.

In another feature, the lock mechanism there has a bias member oriented to urge the third fitting toward the first position thereof. The bias member is a spring having a first end and a second end, the first end being mounted to bear against the body of the lock mechanism, the second end having a foot for reaction against the datum structure. In another feature, the first degree of freedom of motion is an angular degree of freedom, and the predominantly crosswise motion is predominantly circumferential motion about an axis of rotation. In a feature the first fitting is a hinge, the axis of rotation is an axis of rotation of the hinge, and the axis of rotation of the hinge is substantially parallel to the axial direction of the door actuating transmission. In still another further feature, the first fitting of the lock mechanism includes a hinge and a footing of the hinge for mounting to the datum structure. The axis of rotation is an axis of rotation of the hinge, and the footing has a substantially planar footprint. The axis of rotation of the hinge is angularly inclined relative to the substantially planar footprint. In yet another feature, the lock mechanism has all or any combination of the forgoing additional features.

In still another aspect of the invention there is a railroad hopper car for carrying particulate material. The hopper car there has a hopper and first and second end sections for carriage by respective first and second railroad car trucks for rolling motion along railroad tracks in a longitudinal direction. The hopper is suspended between the first and second end sections. The hopper has a discharge section through which to release lading, and first and second end slope sheets oriented toward the first and second end sections, the slope sheets being inclined in the longitudinal direction to feed the discharge section. The first end section includes a draft sill extending in the longitudinal direction, a main bolster extending crosswise to either side of the draft sill, and a shear plate mounted to the draft sill and to the main bolster. The shear plate extends lengthwise along the draft sill and crosswise from side to side of the hopper car. The first end slope sheet of the hopper overhangs the shear plate of the first end section. The hopper car is free of primary structure directly above the shear plate of the first end section under the overhang of the first slope sheet of the hopper.

In another feature of that aspect of the invention, there is one of: (a) the first slope sheet has an upper margin and the hopper car includes an end post extending upwardly from the draft sill to the upper margin of the slope sheet; and (b) the first slope sheet has an upper margin terminating at an end wall, and the hopper car includes an end post extending upwardly from draft stub sill to the end wall. In another feature, the shear plate has a longitudinally outboard margin and the draft sill has a striker located outboard of the longitudinally outboard margin of the shear plate, and the end post is one of: (a) rooted to the draft sill adjacent to the striker; (b) rooted to the shear plate adjacent to the longitudinally outboard margin of the shear plate. In a further feature, the bolster has first and second laterally outboard distal ends, and the hopper car has corner posts extending upwardly from the distal ends of the hopper to the first slope sheet.

In still another feature, the bolster has first and second laterally outboard distal ends, and the hopper car has corner posts extending upwardly from the distal ends of the hopper to the first slope sheet. In another feature, one of: (a) the first slope sheet has an upper margin and the hopper car includes an end post extending upwardly from the draft sill to the upper margin of the slope sheet; and (b) the first slope sheet has an upper margin terminating at an end wall, and the hopper car includes an end post extending upwardly from draft stub sill to the end wall; the shear plate has a longitudinally outboard margin and the draft sill has a striker located outboard of the longitudinally outboard margin of the shear plate, and the end post is one of: (a) rooted to the draft sill adjacent to the striker; (b) rooted to the shear plate adjacent to the longitudinally outboard margin of the shear plate. The bolster has first and second laterally outboard distal ends, and the hopper car has corner posts extending upwardly from the distal ends of the hopper to the first slope sheet. The hopper car has a machinery space bounded by (a) the first slope sheet; (b) the shear plate of the first end section; (c) the end post; and (d) the corner posts, and the machinery space is free of any other primary structure.

In yet another feature the hopper car has at least one longitudinally hinged discharge door, the discharge door being movable crosswise between open and closed positions. A longitudinally acting pneumatic actuator is at least partially lodged in the machinery space directly above the draft sill. In still yet another feature a brake reservoir is also at least partially lodged in the machinery space. In a yet further feature the shear plate is mounted above and to the main bolster and defines an upper flange thereof. The main bolster has a lower flange downwardly spaced from the upper flange, the lower flange terminating at respective distal end portions at either side of the car. The car includes a side sill running along the car between the first and second end sections. The side sill has an upper flange, the upper flange of the side sill being substantially co-planar and connected to the shear plate. The side sill has a lower flange, the lower flange of the side sill being substantially co-planar with a respective one of the distal end portions of the lower flange of the main bolster. In another further feature, the shear plate defines an upper flange of the draft sill whereby the draft sill upper flange, the shear plate and the side sill upper flange are all substantially co-planar. In another feature the machinery space is free of elephant ears.

In a further aspect of the invention there is a railroad freight car having a freight car body for carrying lading, the body being mounted on railroad car trucks for rolling motion in a longitudinal direction along railroad tracks. The car body includes a draft sill having a draft gear pocket for accommodating draft gear, and a shear plate overlying the draft sill and functioning as an upper flange of the draft sill. The draft sill has an inboard end oriented toward a truck center of one of the trucks, and an outboard end terminating at a striker. The draft sill has an underside and an access opening formed in the underside to admit entry of draft gear into the draft gear pocket from below. The car has a draft gear carrier plate. The carrier plate is mounted to the underside of the draft sill beneath the draft gear pocket. The carrier plate is removable to permit installation of the draft gear into the draft gear pocket. The car body has one of (a) an aperture formed in the shear plate over an inboard end region of the draft sill, the aperture permitting a portion of the draft gear to protrude upwardly therethrough during installation in the draft gear pocket; and (b) a coupler carrier seat defined in the draft sill longitudinally inboard of the striker, and a coupler carrier co-operable therewith, the coupler carrier being removable to permit installation of draft gear in the draft pocket, and, when the coupler carrier is installed, the coupler carrier providing a support for a coupler shank when the coupler shank is connected to the draft gear within the draft sill.

In another feature of that aspect of the invention the freight car has both (a) and (b). In another feature, there is a cover plate for the aperture of the shear plate, the cover plate being removable to permit installation of the draft gear. In still another feature, the draft sill has a pair of vertically oriented, longitudinally running spaced apart side webs. The webs have a greater depth of section adjacent to the striker. The webs have respective first and second apertures formed therein. The first and second apertures define the draft gear retainer seat, and the retainer is a sideways slidable shaft that is movable to extend across the draft sill between the first and second apertures in the draft sill side webs. In a further feature there is a cover plate for the aperture of the shear plate, the cover plate being removable to permit installation of the draft gear. In another further feature the draft sill has a centerplate centered on the truck center, rear draft stops are welded within the draft sill, and at least a portion of each of the rear draft stops extends longitudinally inboard of the truck center. In still another further feature, the car is one in which at least one of (a) the freight car has a truck center to striker plate draft sill length of less than 50 inches; and (b) the freight car has a truck center to coupler pulling face length of less than 65 inches when the draft gear is fully extended in draft. In another feature, the railroad freight car is one in which at least one of (a) the freight car has a truck center to striker plate draft sill length of about 38 inches (+/−2"); and (b) the freight car has a truck center to coupler pulling face length of about 53 inches (+/−2") when the draft gear is fully extended in draft.

These and other aspects and features of the invention may be understood with reference to the description which follows, and with the aid of the illustrations.

BRIEF DESCRIPTION OF THE FIGURES

The description is accompanied by a set of illustrative Figures in which.

DETAILED DESCRIPTION

Figure 1:
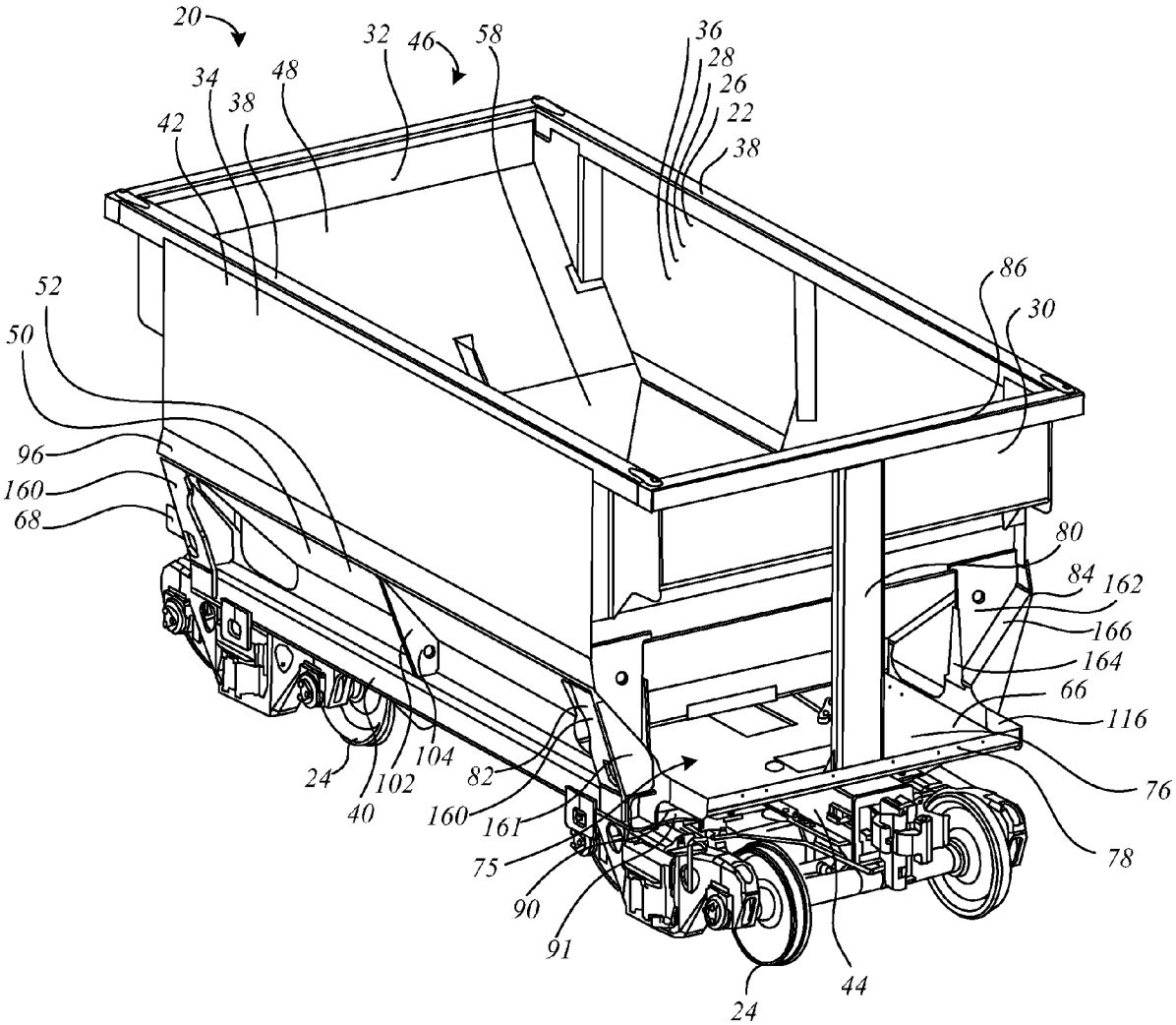
FIG. 1 is a general arrangement, isometric view of a railroad freight car according to an aspect of the invention with all ancillary systems removed to leave only primary structure visible.
Figure 2A:
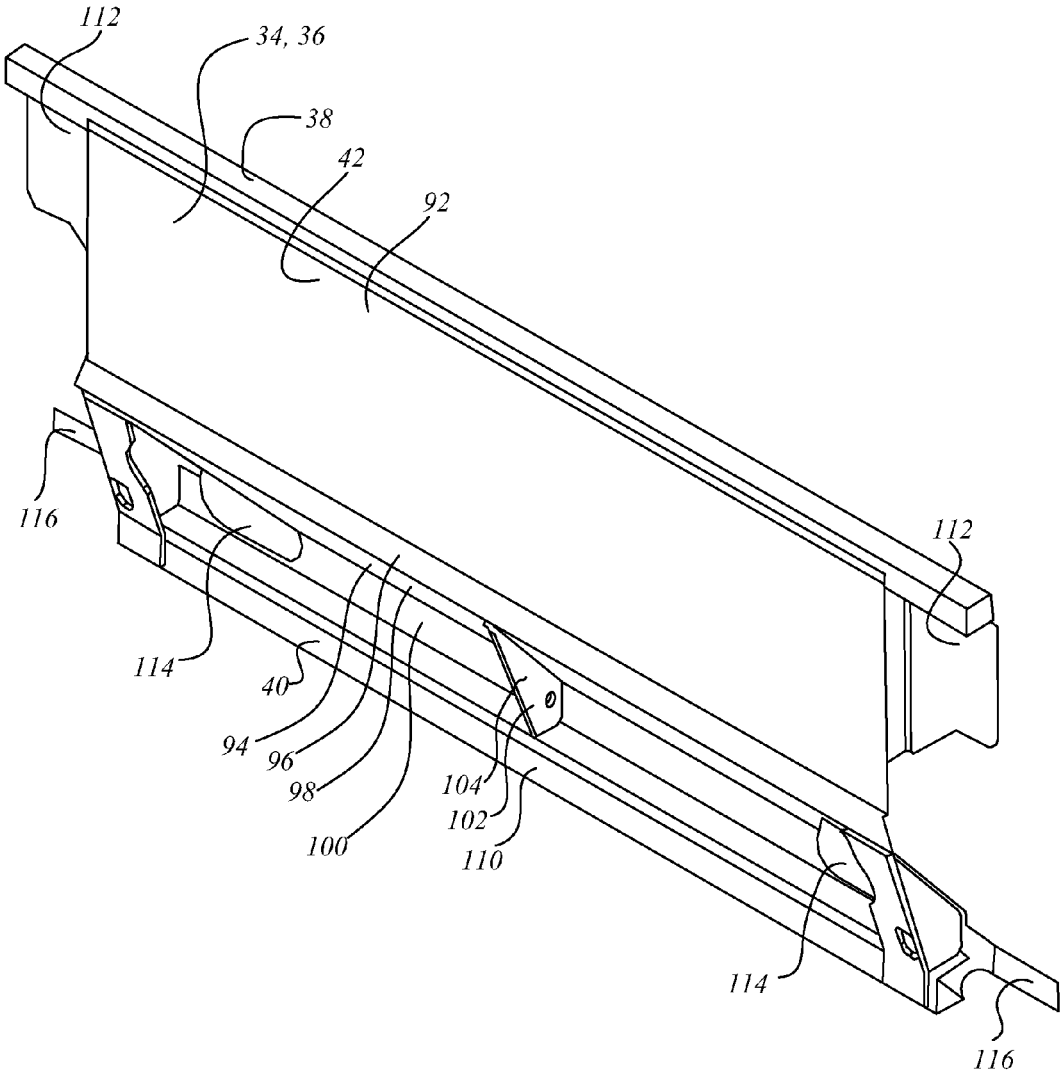
FIG. 2*a* is an isometric view of a sidewall of the gondola car of FIG. 1.
Figure 2B:
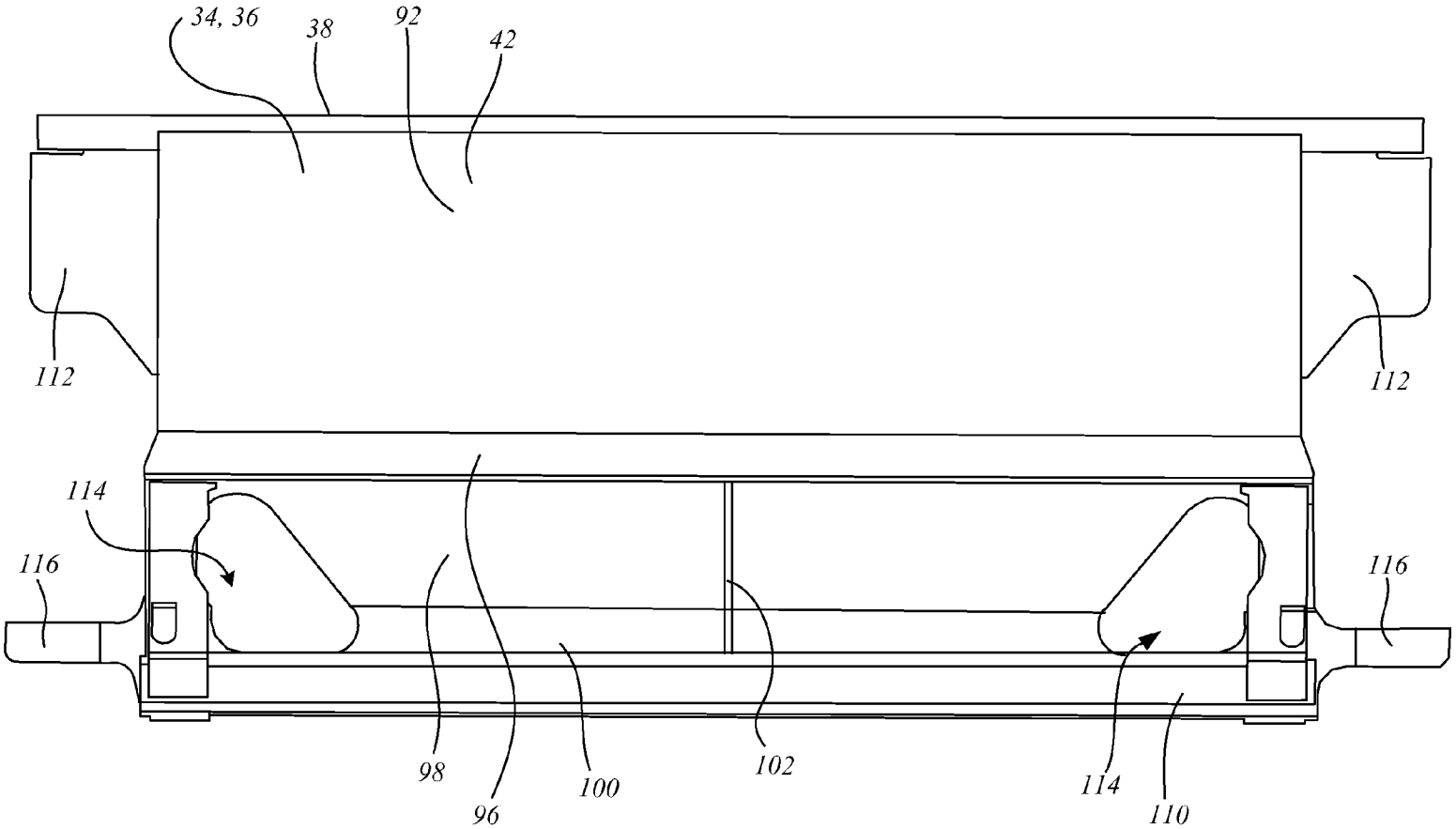
FIG. 2*b* shows a side view of the sidewall of FIG. 2*a;*
Figure 2C:
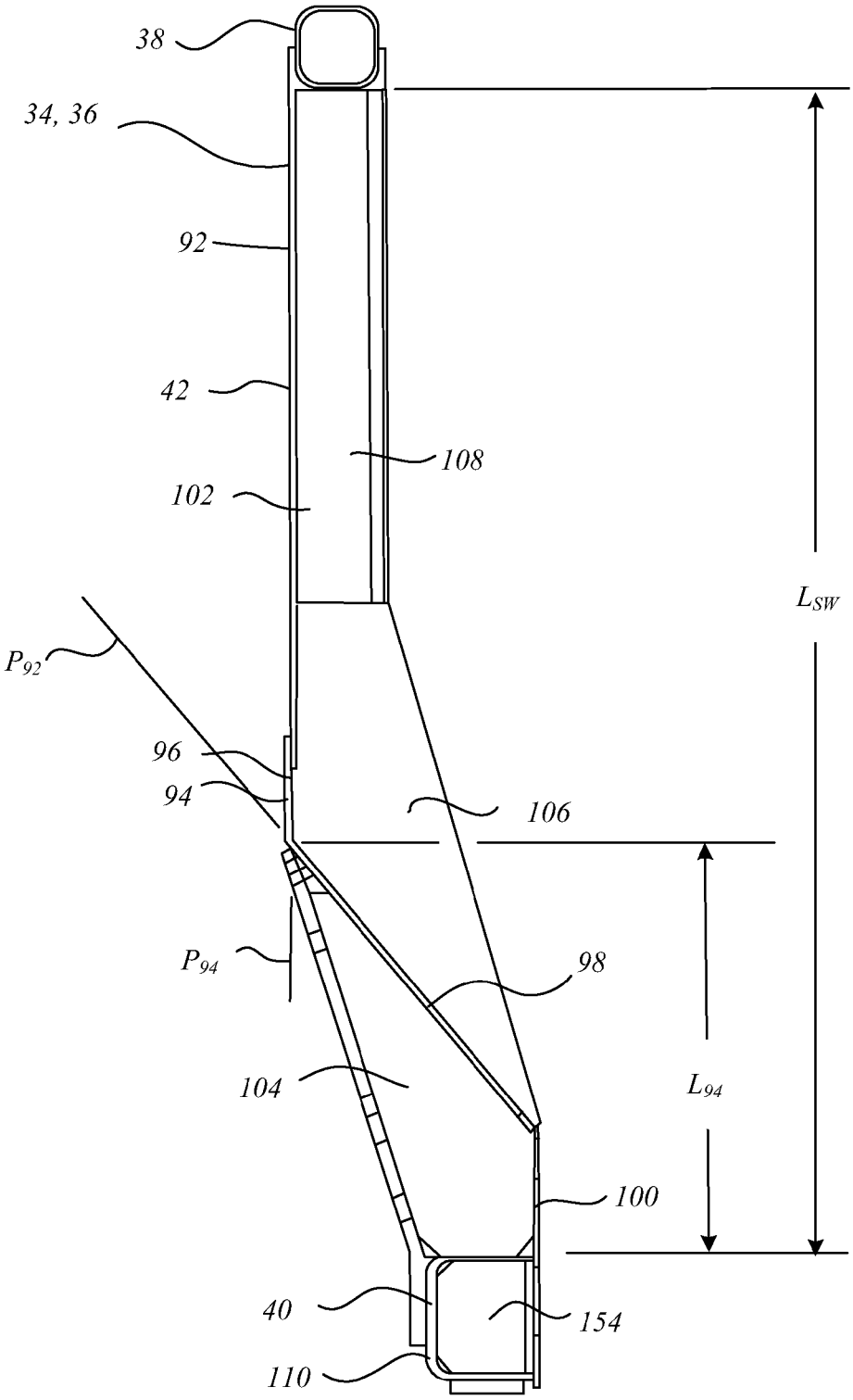
FIG. 2*c* shows an end view of the sidewall of FIG. 2*a;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise.

The terminology used in this specification is thought to be consistent with the customary and ordinary meanings of those terms as they would be understood by a person of ordinary skill in the railroad industry in North America. Following from decision of the CAFC in Phillips v. AWH Corp., the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of at least 10 years experience in the industry in North America or in other former territories of the British Empire and Commonwealth.

In terms of general orientation and directional nomenclature, for railroad cars described herein the longitudinal direction is defined as being coincident with the rolling direction of the railroad car, or railroad car unit, when located on tangent (that is, straight) track. In the case of a railroad car having a center sill, be it a stub sill or a straight-through center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the railroad car described herein may tend to have both longitudinal and transverse axes of symmetry, a description of one half of the car may generally also be intended to describe the other half as well, allowing for differences between right hand and left hand parts. In this description, the abbreviation kpsi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

Bottom dumping hopper cars, of which ore cars and coal cars may be examples, may tend to have either longitudinal doors or transverse doors. Longitudinal doors are oriented such that the doors operate on hinges or axes of rotation that are parallel to the direction of travel of the railroad car generally. U.S. Pat. No. 4,250,814 of Stark et al., issued Feb. 17, 1981 and U.S. Pat. No. 3,800,711 of Tuttle, issued Apr. 2, 1974 show cars with longitudinal doors. By contrast, transverse doors are ones in which the axes of rotation of the hinges or other pivots tend to be predominantly crosswise to the direction of travel, most often perpendicular to it. An example of a transverse door car shown in U.S. Pat. No. 4,843,974 of Ritter et al, issued Jul. 4, 1989.

FIG. 1 shows an isometric view of an example of a railroad freight car 20 that is intended to be representative of a range of railroad cars in which one or more of the various aspects of the present invention may be incorporated. While car 20 may be suitable for a variety of general purpose uses, it may be taken as being symbolic of, and in some ways a generic example of, a flow through car, in which lading is introduced by gravity flow from above, and removed by gravity discharge through gated or valved outlets below. Flow through, or center flow cars may include open topped hopper cars, grain cars, plastic pellet cars, potash cars, ore cars, coal gondolas, and so on. In one embodiment car 20 may be a hopper car such as may be used for the carriage of bulk commodities in the form of a granular particulate, be it in the nature of relatively coarse gravel or fine aggregate in the nature of fine gravel or sand or various ores, ore concentrate or coal. The principle, or primary, structure of car 20 may be symmetrical about both its longitudinal and transverse, or lateral, centerline axes. Consequently, it will be understood that the car has first and second, left and right hand side beams, bolsters and so on.

By way of a general overview, car 20 may have a car body 22 that is carried on trucks 24 for rolling operation along railroad tracks. Car 20 may be a single unit car, or it may be a multi-unit car having two or more car body units, where the multiple car body units may be substantially permanently connected at an articulated connector, or by draw bars, as opposed to by ordinarily releasable AAR couplers. Car body 22, and the various structural members and fittings described herein may be understood to be typically of metal construction, whether welded or Huck(t.m.) bolted, or riveted together, the metal members being most typically steel, stainless steel, or aluminum, as may be appropriate. Some car builders have also used reinforced plastic composites for car elements, and those materials could also be employed where suitable. The default construction may be taken as being steel, of which the majority may be mild steel having, typically, a 50 kpsi yield. Car body 22 may have a lading containment vessel or shell 26 such as may include an upstanding wall structure 28 which may have a pair of opposed first and second end walls 30, 32, that extend crosswise, and a pair of first and second side walls 34, 36 that extend lengthwise, the end walls 30, 32 and side walls 34, 36 co-operating to define a generally rectangular form of peripheral wall structure 28. Wall structure 28 may include top chords 38 running along the top of the walls, and side sills 40 running fore-and-aft along lower portions of the side sheets or side sheet assemblies 42 of side walls 34, 36. In some instances, such as that of the illustration of FIG. 1*a*, car 20 may have stub center sills 44 at either end, in which case side walls 34, 36 may act as deep beams, and may carry vertical loads to main bolsters 90 that extend laterally from the centerplates. In the case of a single, stand alone car unit, draft gear and releasable couplers may be mounted at either end of the stub center sill. In a center flow, or flow through car, the upper portion of the car may typically include means by which to admit lading under a gravity drop system. Such an intake 46, or entryway may be a large rectangular opening such as that bounded by top chords 38.

Car body 22 may include end sheets 48 and side sheets 50. Car 20 of FIG. 1 et seq., is illustrated as a car having a single hopper 52, a single hopper discharge section 54, and an outflow or discharge governor in the nature of a discharge door assembly 56. However, car 20 could, alternatively, be a multiple hopper car. In a multiple hopper car, the car may have laterally extending members or reinforcements, which may be cross-bearers, or cross-bearers with shrouds, or merely shrouds, particularly where the car is a multiple hopper car. These cross-members may run fully across the car from side sill to side sill, and may intersect the center sill, or the center sill shroud as may be. The car may also include upper wall bracing, in the nature of diagonal struts which extend diagonally upwardly and outwardly from the apices of the respective cross-members at the centerline of the car to upper regions of the side walls near or at the top chords; and lateral ties or struts that run across the car from sidewall to side wall to meet the upper ends of the diagonal struts at their wall brackets. Those brackets may be aligned with, and mated through the wall to, the vertical exterior posts that run from the side sill to the top chord and reinforce the walls.

End sheets 48 may be substantially planar slope sheets or slope sheet assemblies that are inclined downwardly in the longitudinally inboard direction to feed the discharge section. Not atypically, each pair of fore-and aft opposed slope sheets may be inclined at equal and opposite angles, and the angles of those sheets may be selected to be somewhat steeper than the free slope angle, or natural talus slope angle of the lading for which the car is designed, such that, when the gates are opened, the lading may tend to flow out, rather than sit at rest.

The primary structure of body 22 of car 20 includes lading containment vessel 26 which is in the nature of hopper 52. Hopper 52 has an upper portion 58 with substantially vertical wall panels , and a lower stationary portion defined by a set of converging sloped walls, namely the side and end slope sheet assemblies 48 and 50. At the lower margin of the sloped walls there is the outflow governor, namely door assembly 56, which, in this instance, may have the form of a pair of first and second, or left and right hand doors 62, 64. This containment structure seats on, and is carried by, a pair of first and second end structures, 66, 68, at either end of the car. End structures 66, 68 are in turn carried by trucks 24. A door operating apparatus or mechanism, or drive train, or transmission, however it may be termed, and identified generally as 70, is provided to move doors 62, 64 between open and closed positions.

Considering this structure in greater detail, trucks 24 are most immediately surmounted by center plates 72 of longitudinally extending stub sills 44. Stub sills 44 in turn carry laterally extending main bolster arms 74 of main bolster 90. Arms 74 extended perpendicularly away from the centerplate 72, i.e., they are centered on the truck center, CL—Truck. Side sills 40 run lengthwise along the car between, and tie together, the most laterally outboard extremities of main bolster arms 74. A shear plate 76 is mounted in an x-y horizontal plane defining the top cover plate of stub sill 44. Shear plate 76 extends laterally from side sill to side sill, and longitudinally from the fore-and-aft end slope sheet 48 to the laterally extending end sill 78 of the car, which, in this instance may be an upturned flange formed on the longitudinally outboard margin of shear plate 76. In car 20, the primary structure includes an end post 80 and a pair of side or corner posts 82, 84.

End post 80 is rooted in shear plate 76 in line with center sill 44, and may have lateral webs or gussets aligned with the webs of stub sill 44 to provide vertical web continuity across shear plate 76. End post 80 then extends fully between shear plate 76 and top chord 86 of end wall 30 or 32, as may be. Corner posts 82 and 84 are rooted to, and stand upwardly from, the junction of the laterally outboard ends of left and right hand main bolster arms 74 and side sills 40. Posts 82 and 84 extend upwardly from this junction to mate with various elements of the end and side walls, as may be described below.

As described in additional detail below, car 20 has an abnormally short distance from the striker 88 to the truck center, i.e., the CL of centerplate 72. Striker 88 is the vertical planar surrounding face plate at the outboard end of the stub sill 44. In the terminology of the industry, the portion of the center sill 44 (be it a stub center sill or a straight through center sill) that lies longitudinally outboard of the truck center CL-Truck may also be referred to as the draft sill. In car 20, the short draft sill length, identified as $L_{88}$, leaves an anomalously small space in which to install other systems, such as the brake reservoir and the door operating pneumatic cylinder. Car 20 has an end of car machinery space, indicated generally as 75, that is bounded by shear plate 76 on the bottom, the sloped end wall assembly 30 or 32 of the car on the top, main vertical central end post 80, and main side posts 82, 84 at the ends of main bolster 90. This space may be referred to as having the shape, generally, of a triangular prism and is substantially unobstructed by the primary structure of the car. For the purposes of this description, primary structure is defined as the underframe, including side sills and center sill (i.e., including the draft sill), the side walls, the slope sheets and top chords, the hopper construction including the stationary parts of the discharge section, as well as any cross-bearers, cross-ties, bolsters, shear plates and so on. Primary structure excludes secondary or ancillary structure or systems such as ladders, cat-walks and other safety appliances, brakes, brake rods and brake fittings, air hoses, reservoirs and pneumatic fittings, movable door members, door operating linkages, and so on.

In existing cars, this space, 75, is often occupied or otherwise obstructed by other primary structure, such as so-called "elephant ears". In this context, "elephant ears" are large, substantially triangular planar plates, sometimes provided with central lightening holes, that have one edge fixed along the junction of the center sill webs and the center sill cover plate, and another edge welded to the end slope sheet. The third edge is typically a free edge. Often these plates lie in a plane that is oriented at an angle to the vertical—i.e., it leans laterally outboard. Car 20 avoids the use of these "elephant ears" and so provides the large unobstructed space shown in FIG. 1*b*.

FIGS. 1 and 2*a*, 2*b* and 2*c*, all show the sidewall of the car, indicated generally as 34 or 36. Sidewall 34 and 36 function as short beams of low (e.g., less than 4:1, possibly less than 3:1) length-to-depth ratio. Sidewall 34 or 36 can be seen to have a bottom flange or chord member, namely side sill 40, a top flange or chord member, namely top chord 38, which may have the form of a square or rectangular hollow structural steel tube; and an intermediate shear force transfer web, namely side sheet assembly 42. Side sheet assembly 42 may include an upper sheet portion or member 92 that is welded to the outside face of top chord 38 at a lap joint, and that extends downwardly therefrom; and a lower sheet portion or member 94. Member 94 may have the form of a Z-section, having a first portion, namely an upper flange or leg or margin 96 that extends in a substantially vertical plane and has an uppermost margin that overlaps the lowermost edge or margin of member 92; a second or intermediate portion 98 that runs in an inclined plane sloping inwardly and downwardly on the slope of the hopper side sheets generally, and a third or bottom portion, namely bottom flange, or leg, or margin 100 that extends in a substantially vertical plane downwardly. Sidewall 34 or 36 also includes a central post, or web stiffener, 102 that has a lowermost first portion 104 an intermediate second portion 106, and an uppermost third portion 108.

Side sill 40 includes a channel 110 that is welded toes-inward against the lowermost marginal portion of lower leg 100 to form a closed section. The first or lowermost portion 104 of web stiffener 102 has the form of a quadrilateral gusset having a first edge welded to the upper leg of channel 110, a second edge welded to the vertical margin 100, a third edge welded to the sloping portion 98, and the fourth, laterally outboard, edge being free. As may be noted, portion 104 stands outboard of the sidewall sheet.

Portion 108 is a rectangular web stiffener that is welded to, and extends downwardly from, the underside of top chord 38 along the inside face of vertical web portion 92. Intermediate portion 106 is a web, or plate, or gusset, that is also a quadrilateral, having a first edge that overlaps, and is welded to, the lower margin of portion 108. A second edge is welded to the lower region of vertical web portion 92, and to the upper flange or leg 96. A third edge is welded along the sloped portion 98 of member 94. The fourth edge is free, and faces inwardly into the lading containment space of the hopper. Portions 104 and 106 are co-planar, or substantially co-planar, such that stiffener 102 has web continuity through member 94. The upper margin of the side slope sheet 50 of the hopper discharge section is welded to the lower margin of the inclined or sloped portion 98, such that the structure presents a continuous sloped surface for containing, and then slidingly discharging, particulate lading. Expressed differently, the web of the sidewall traverses the sidewall stiffener, commencing on its inboard margin at side sill 40, traverses the web mid-way up the post, and ends along its outboard margin at top chord 38. In this arrangement, the vertical stiffener, 102, acts as the web of a T-section, and the local region of the wall section to which it is joined functions as the flange of that T-section.

In this example, the locus of intersection of the side slope sheet plane $P_{94}$ with the plane of the side wall sheet $P_{92}$, lies above the level of side sill 40 by a substantial distance, indicated as $L_{94}$. This distance may lie in the range of ¼ to ⅔ of the distance $L_{sw}$ from side sill 40 to top chord 38, and, in the particular may be about ⅓ of that distance. Further, although the post has stiffening member web continuity in a vertical plane, the wall sheet traverses the stiffening web intermediate the top chord and the side sill, and does so obliquely on the slope of plane $P_{94}$.

The upper leg of channel 110 forms the upper flange of side sill 40, and the lower leg of channel 110 forms the lower flange of side sill 40. Shear plate 76 forms the top flange of main bolster 90. Main bolster 90 also has a lower or bottom flange 91. In car 20 the upper leg of channel 110 is co-planar or substantially co-planar with, and is connected in flange continuity with, shear plate 76. Similarly, the lower leg of channel 110 is co-planar or substantially coplanar with, and connected in flange continuity with, bottom flange 91 of main bolster 90.

Continuing with the sidewall assembly, the main sheet, namely upper sheet portion 92, ends at the corners, and there are respective first and second end upper web stiffener portions and inwardly stepped plate members 112, which may be termed "ears". The top edge of each ear is welded to the inside face of top chord 38 in a lap joint. The longitudinally outboard end edge forms a plane to which the vertical end sheet of the end slope sheet wall abuts and is welded. The bottom edge follows the slope of, and is welded to, end slope sheet 48. The forward, transversely outwardly bent edge is welded to the upper end portion of side sheet assembly 42. The lower region of the main sidewall sheet also includes lightening apertures 114, in the space between the corner posts and the slope of the end slope sheets. Finally, the lower portion of region 100 of the main sidewall sheet has longitudinal extensions 116 that are welded to the side edges of the shear panel, namely shear plate 76, outboard of main bolster 90, thereby forming a portion of the peripheral flange of the shear plate.

End walls 30, 32 each include upper and lower sloped surface members 122 and 124, which could be made as a single piece, or as two pieces butt-welded together, as here. Upper member 122 has notches 126 formed therein to accommodate corresponding corner posts 82, 84 as may be, with local reinforcement doublers 128 at the junction. Lower portion 124 tapers in width to match the narrowing width between the sloped side sheets with which it mates. At the upper end of end wall 30 the end wall assembly includes a laterally extending first formed member 130 that has a first, vertical leg 132 that laps the inside face of the top chord 86, and a bent flange 136 that extends initially horizontally, with a distal lip bent upward to mate perpendicularly with the upper margin 138 of the end slope sheet 48. The distal tip of end slope sheet 48 is fillet welded to vertical leg 132. This results in a substantially triangular closed section defining a laterally extending end slope sheet reinforcement beam 140. The ends of this beam abut, are welded to, and are capped by elephant ears 112. Vertical leg 132 also lies against, and is welded to, end post 80.

A formed angle 142 is mounted toes-in at an intermediate height on sloped end wall 48, forming thereby another hollow section laterally extending end sheet reinforcement or beam 148. Vertical leg 144 of angle 142 is substantially aligned with the central web of the corner post (be it 82 or 84) and therefore also with the central web of the main bolster. Another formed angle 150 is welded toes-in to the back of sloped end wall 30 at the level of shear plate, thereby forming yet another slope-sheet reinforcement in the form of a laterally extending beam.

The corner posts 82 and 84 each have a lower corner post flange plate 160 (that includes a lifting lug aperture) that has a bottom tab welded to the outside, or back, of the end of side sill 40 in line with the main bolster, then an angled portion following the angle of the outside edge of the vertically extending side wall reinforcements, 161, to an upper end at the juncture of the side slope sheet with the side wall vertical leg of the lower side wall sheet. Each end post has two internal reinforcements 154. Each corner post also includes an intermediate member, or web, or gusset, or plate 162, which is considerably wider than intermediate gusset 106, and a substantially triangular inside edge web stiffener 164. Plate 162 is a quadrilateral. A first edge of plate 162 runs along the upward and outward slope of wall extension 166. A second edge runs vertically against the upper leg of wall extension 166. A third upper edge adjacent runs horizontally along lateral reinforcement beam 148. The fourth edge runs vertically downward to and along edge stiffener 164. As such, a vertical post is established.

Figure 3A:
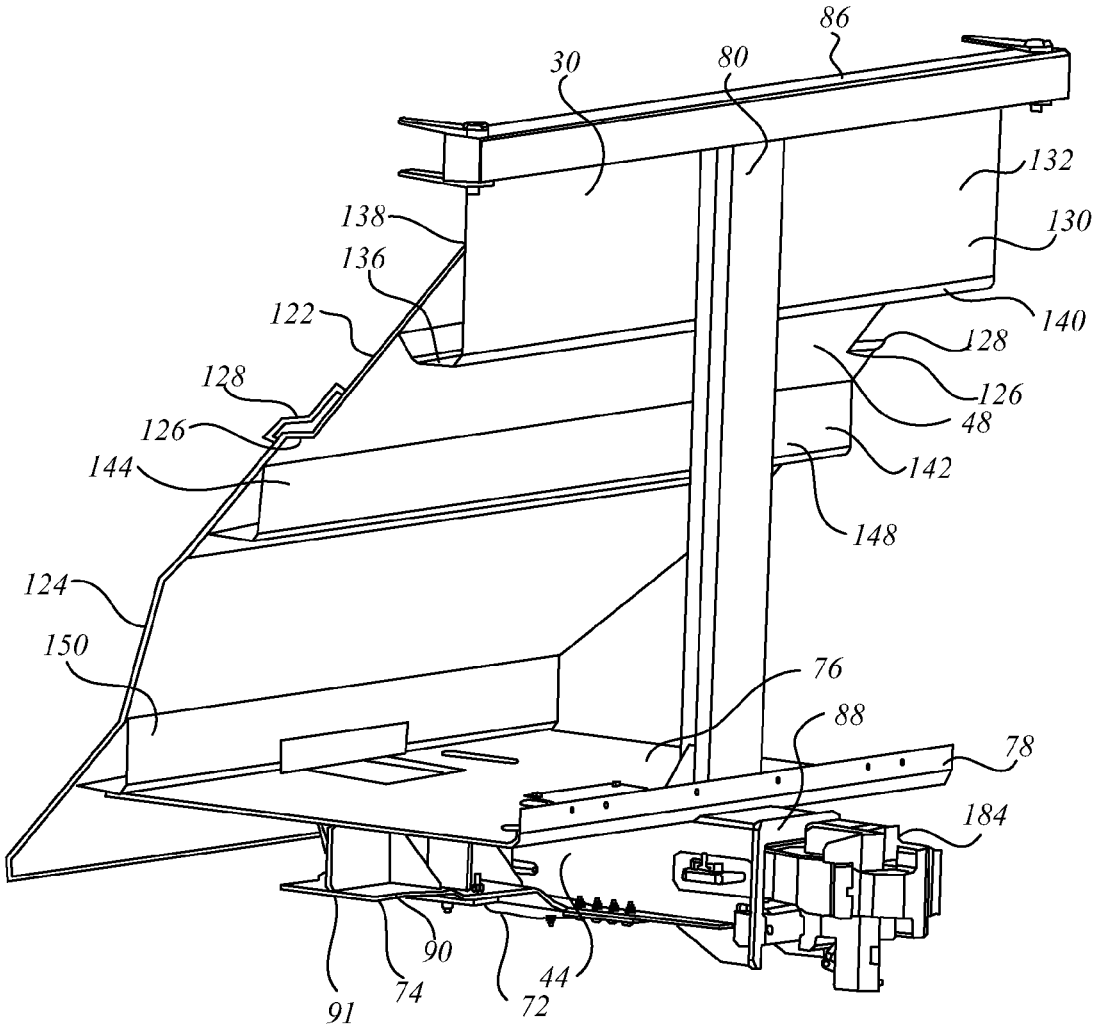
FIG. 3*a* shows a perspective view of the end structure of the railroad freight car of FIG. 1.
Figure 3B:
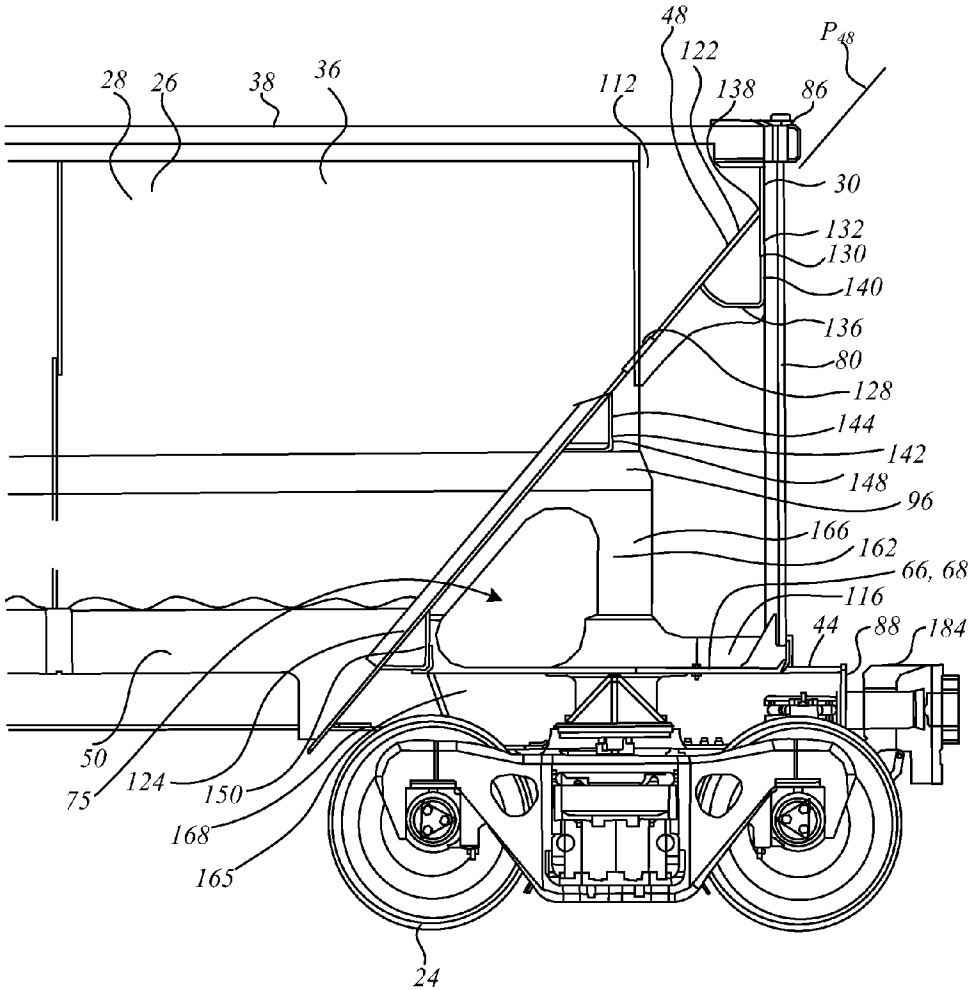
FIG. 3*b* is a side view of the structure of FIG. 3*a;*
Figure 3C:
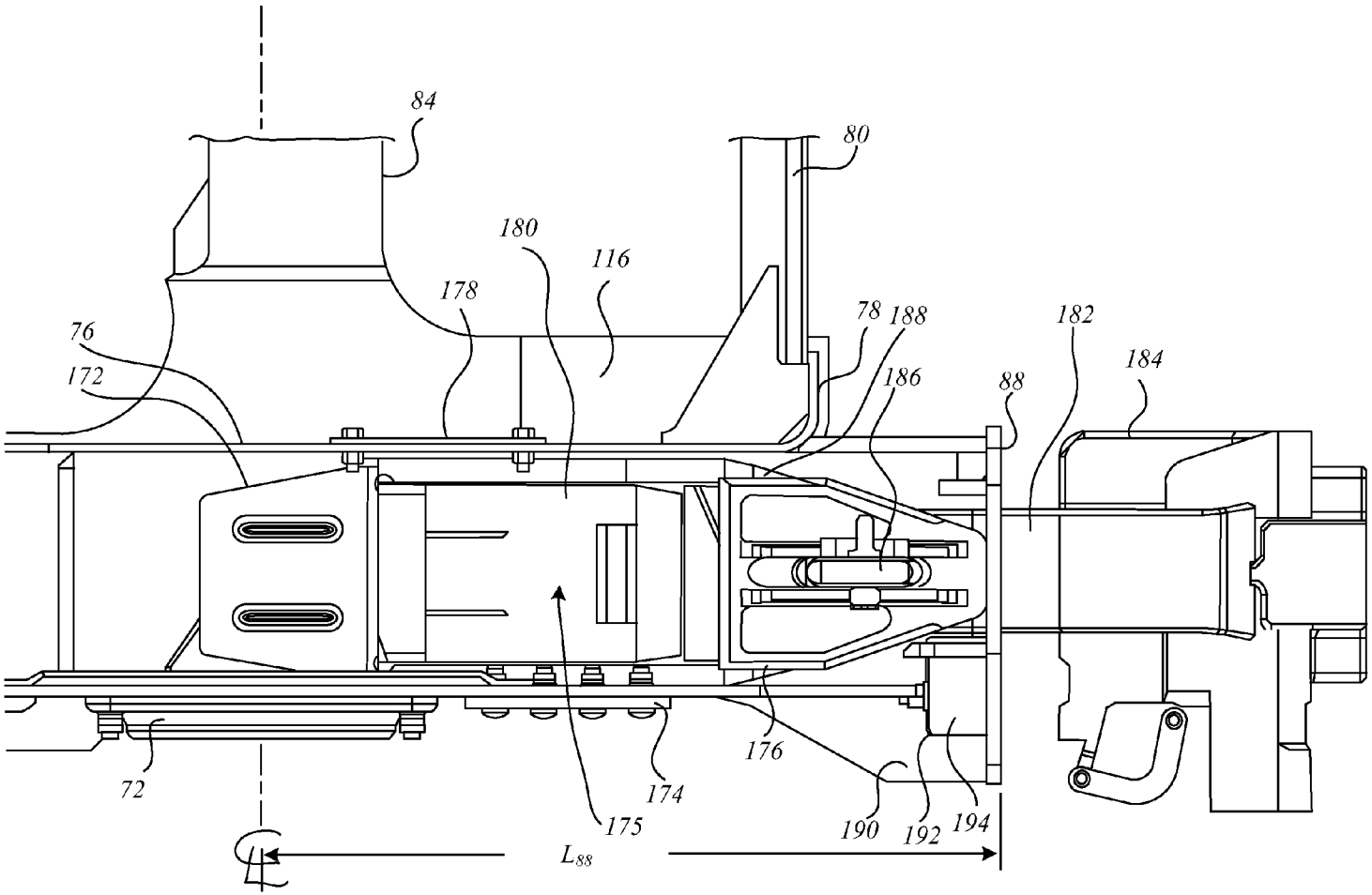
FIG. 3*c* is a detail of the end structure of FIG. 3*b*, with the near side web of the draft sill removed to show the draft stop, center plate, and coupler relationship.

Considering FIGS. 3*a*, 3*b* and 3*c*, center sill 44 includes a bottom flange or bottom cover plate 165, and a pair of spaced apart webs 168. The central region of shear plate 76 forms the top flange, or top cover plate of the center sill. At its inboard end, the center sill terminates centrally under the bottom lateral reinforcement of the end slope sheet 48. A draft pocket 175 is defined between webs 168, shear plate 76 and bottom cover plate 165 longitudinally inboard of the striker plate.

Center plate 72 is mounted at truck center CL-Truck, in line with main bolster 90 and the corner posts 82, 84. Rear draft stops 172 are welded within the center sill above center plate 72. As seen in FIG. 3*c*, the inboard end of rear draft stop 172 extends longitudinally inboard of the truck center. While this is known to have been used in at least one single piece, integrally cast draft sill, the inventor is unaware of such a construction in an all-welded fabrication draft sill assembly. The removable draft sill access cover plate, or draft gear carrier plate 174, which is bolted to the draft sill (i.e., the stub sill) bottom flange margins, is mounted immediately longitudinally outboard of center plate 72. Front draft stops 176 are, in turn, mounted longitudinally outboard of carrier plate 174. In this embodiment there is also a removable member, such as a top leeway or access plate 178, mounted to shear plate 76. Plate 178 is removed when draft gear 180 is removed or installed. On installation, draft gear 180, to which yoke 188 is already mounted, is fed into draft pocket 175 from below, on an angle, whereby the rear corner protrudes upwardly through the opening that is otherwise covered by plate 178. The front end of draft gear 180 is rotated into place, and the rear end is rotated downward. As this occurs, yoke 188 is also raised into place. Plates 178 and 174 are then reinstalled. The shank 182 of the coupler, 184 is inserted, and the coupler key 186 is fed through the slot in front draft stops 176 to link coupler 184, and yoke 188 in the customary manner. It may be noted that coupler 184 combines an AAR Type E shank with and AAR Type F knuckle with a bottom shelf. Draft gear 180 itself has abnormally short travel, namely about 2½ inches deflection before going solid, as compared to a "normal" deflection of over 3" before going solid.

Draft sill webs 164 have, at their longitudinally outboard end an end portion 190 of increased depth of section with a downwardly protruding bulge or horn, such as might be termed a "chin". End portion 190 has an aperture or slot 192 formed therein to permit lateral sliding insertion of a coupler support, carrier or bar 194 immediately behind striker plate 88. Removal of bar 194 permits yoke 188 to be swung into place during installation of draft gear 180. When coupler 184 is installed, the shank may rest on bar 194. Bar 194 is held in place by bolts that secure it relative to webs 164. Overall, a coupler installation of very short length is achieved. In this example, $L_{88}$ may be in the range of less than 50 inches, and in one embodiment may be about 38"+/−2", from the truck center to the outboard face of striker plate 88. An alternative expression of the relative compactness of the draft gear is that the length from the truck center to the pulling face of the coupler, when the draft gear is extended in tension, is in the range of less than 65 inches, and in one embodiment is in the range of 53"+/−2".

Car 20 may also include a door opening mechanism 200. There are left and right hand, or first and second, doors 62, 64. Each door has a proximal, hinged edge 206, and a distal free edge 208. The hinges are carried on hinge fittings welded to mounting brackets depending from the slope sheets and side sills. The hinges run parallel to the longitudinal or lengthwise axis of the car, generally such that doors 62, 64 are longitudinal doors. Each door has the form of a hollow section beam, having a proximal beam 210 along the hinge side, a distal beam 212 along the free edge, internal cross-braces, not shown, and front and back skins or sheets or plates 214, 216. The hinges are indicated as 220, the end closure plates as 222, 224. The doors have door seal members 226, 228 that mutually engage when the doors are moved to a closed position. Seal members 226, 228 are sprung, such that when they are closed they deflect somewhat and in so doing take on a spring pre-load against each other. The door mechanism includes a pair of first and second, matched left and right hand pivot arms 230, 232; a corresponding pair of first and second drag links 234, 236; a shared yoke 238, and a pair of slave links 240, 242 that each pick up on a knuckle fitting 244, 246 of each of respective doors 62, 64. The whole assembly has left and right hand symmetry.

Inasmuch as, when tripped, doors 62, 64 open under the influence of gravity, particularly when assisted by the weight of the lading being discharged, one may consider the motion that occurs as the doors are closed in the sequence of views 4*a*, 4*b*, and 4*c*; 5*a*, 5*b*, and 5*c*; and 6*a*, 6*b* and 6*c*. Knuckles 244 and 246 are constrained by geometry to move in circular arcs of fixed radii in planes perpendicular to the respective axes of rotation of doors 62 and 64, those axes being the hinge axes of their respective hinges 220, which each lie in a plane parallel to the x-z plane of the car centerline. The plane of rotation of knuckles 244, 246 will then tend to be perpendicular to the central x-z plane. Slave links 240 and 242 are each of fixed length; each has an end pivotally connected at a two rotational degree of freedom knuckle, be it 244 or 246, as may be; each of slave links 240 and 242 has another end pivotally connected at a second pivot connection at yoke 238; and slave links 240 and 242 do not transmit a bending moment, and so therefore pull in pure tension. The upper, or near (i.e., proximal), ends of drag links 234, 236 are connected to the distal ends of pivot arms 230, 232 at pivot connections 248, 250, which may, if desired, share a common axis of rotation or pivot pin.

Figure 5A:
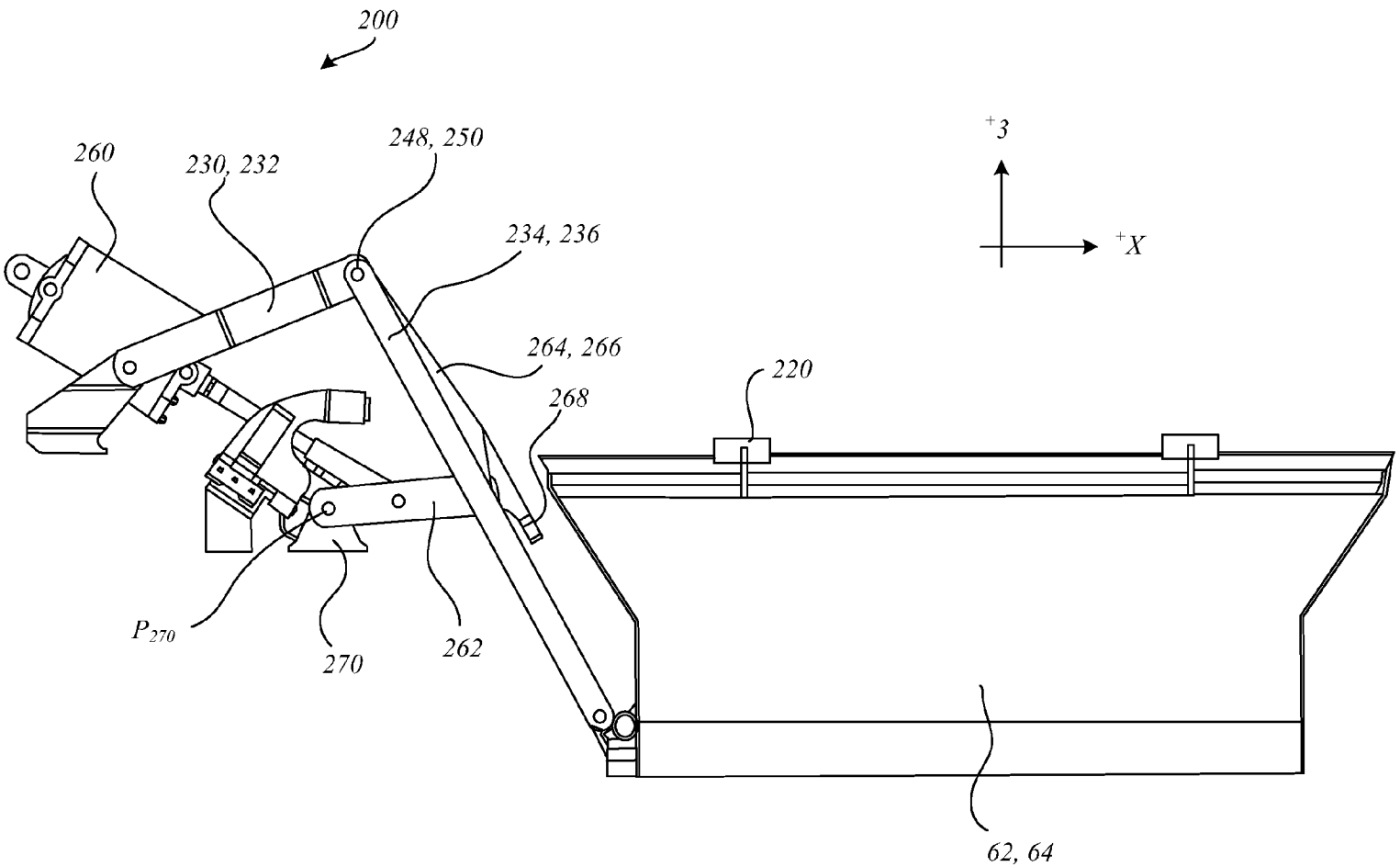
FIG. 5*a* is a side view of the door opening mechanism of FIG. 4*a;*

Yoke 238 is constrained by symmetry to pull in an x-z plane, which in the embodiment illustrated is the vertical plane of the centerline of the car. As such, movement of yoke 238 away from the plane of motion of knuckles 244 and 246 will necessarily draw knuckle fittings 244 and 246 closer together, and toward the vertical centerline plane of the car, eventually causing resilient door seals 226, 228 mutually to engage, thus closing the opening. This motion can be achieved by pulling on drag links 234, 236. Each pivot connection of slave links 240, 242 has a single angular degree of freedom. Similarly yoke 238 has an angular degree of freedom about the axis of rotation of the axle, or trunnions, by which it is pivotally mounted to the drag link, or drag links 234, 236. This gives the drag link connection two angular degrees of freedom in total. As the drag links are withdrawn, the slave links pull in tension, finding the natural hypotenuse between the plane of the arc of motion of knuckle fittings 244, 246 and the plane of motion of drag links 234, 236. Since this mechanism operates in tension, pivot connections 248, 250 and knuckle fittings 244, 246 are co-planar, with drag links 234, 236, yoke 238, slave links 240 and 242, and their associated pivot connections also lying in that same plane as well. (See FIGS. 5*a*, 5*b*, 5*c*).

Driving force for this system is provided by an actuator, identified as 260. Actuator 260 may be a pneumatic actuator, which may be charged by the pneumatic system of the train generally, as supplied through the pressurized air connection of the train line. Actuator 260 may include its own reservoir and check valve. Actuator 260 is connected to move a first member, in the nature of a primary driven pivot arm or lever, 262, which is in this instance actually a pair of matched lever arm members, which in turn is pivotally connected to, and drives, a second member in the nature of, a push rod, or, given the symmetrical nature of the assembly, a pair of left and right hand push rods 264 and 266. One or both of push rods 264, 266 may have a secondary member, such as may be an extending arm, or detent, or stop, or abutment, identified as an over-center travel limiter or governor, 268. The far ends of push rods 264, 266 may be connected to either pivot arms 230 (or 232, as may be), or to drag link 234 (or 236, as may be). It may be convenient to connect the far end of push rods 264, 266 at the same pivot connection, or connections 248, 250.

Figure 5B:
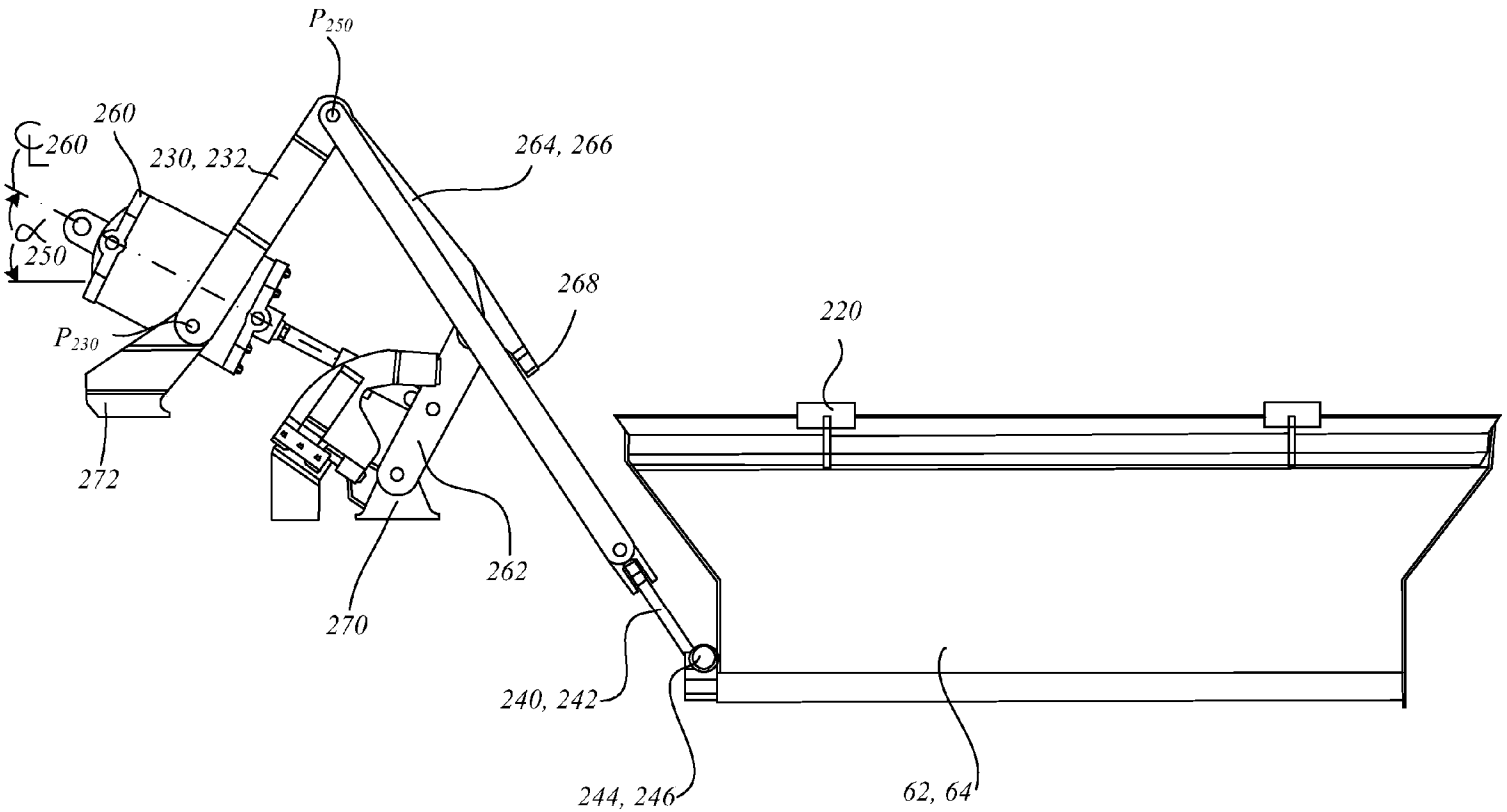
FIG. 5*b* is a side view of the door opening mechanism of FIG. 4*b;*

Lever 262 has a first end pivotally mounted to primary structure of car 20 at footings, identified as mounting fixtures, fittings or brackets 270. The drive rod of actuator 260 picks up on lever 262 at an intermediate location, such that lever 262 provides magnification of displacement. Similarly, pivot arms 230, 232 have a first or base end pivotally connected to primary structure at mounting fixtures, fittings, or brackets 272. Actuator 260 is located on the centerline (i.e., in the central x-z plane) of car 20, between and in substance below pivot arms 230, 232. "Below" in this context may be thought of as radially more proximate to the pivot axis $P_{270}$ of brackets 270 than is the pivot axis of connections 248, 250, as well as in the context of being lower than as in closer to Top of Rail. In the past the lever fitting has more commonly been mounted to the slope sheet such that the output pin is lower than the pneumatic cylinder. Turning this arrangement upside down, in effect, and fitting the cylinder may then permit a more compact installation than otherwise. Similarly, the pivot axis, $P_{230}$, of driven arms 230, 232 is below the output knuckle, i.e., at $P_{250}$, and is below the actuator cylinder as shown in FIG. 5*b* in which $P_{250}$ lies below the center line $CL_{260}$ or actuator 260. This may be taken in the sense of being further from the plane of the end slope sheets, identified as $P_{48}$. Expressed differently, actuator 260 lies between the base or datum pivot point $P_{250}$ of driven arms 230, 232 and the plane $P_{48}$ of end slope sheet 48.

Figure 4A:
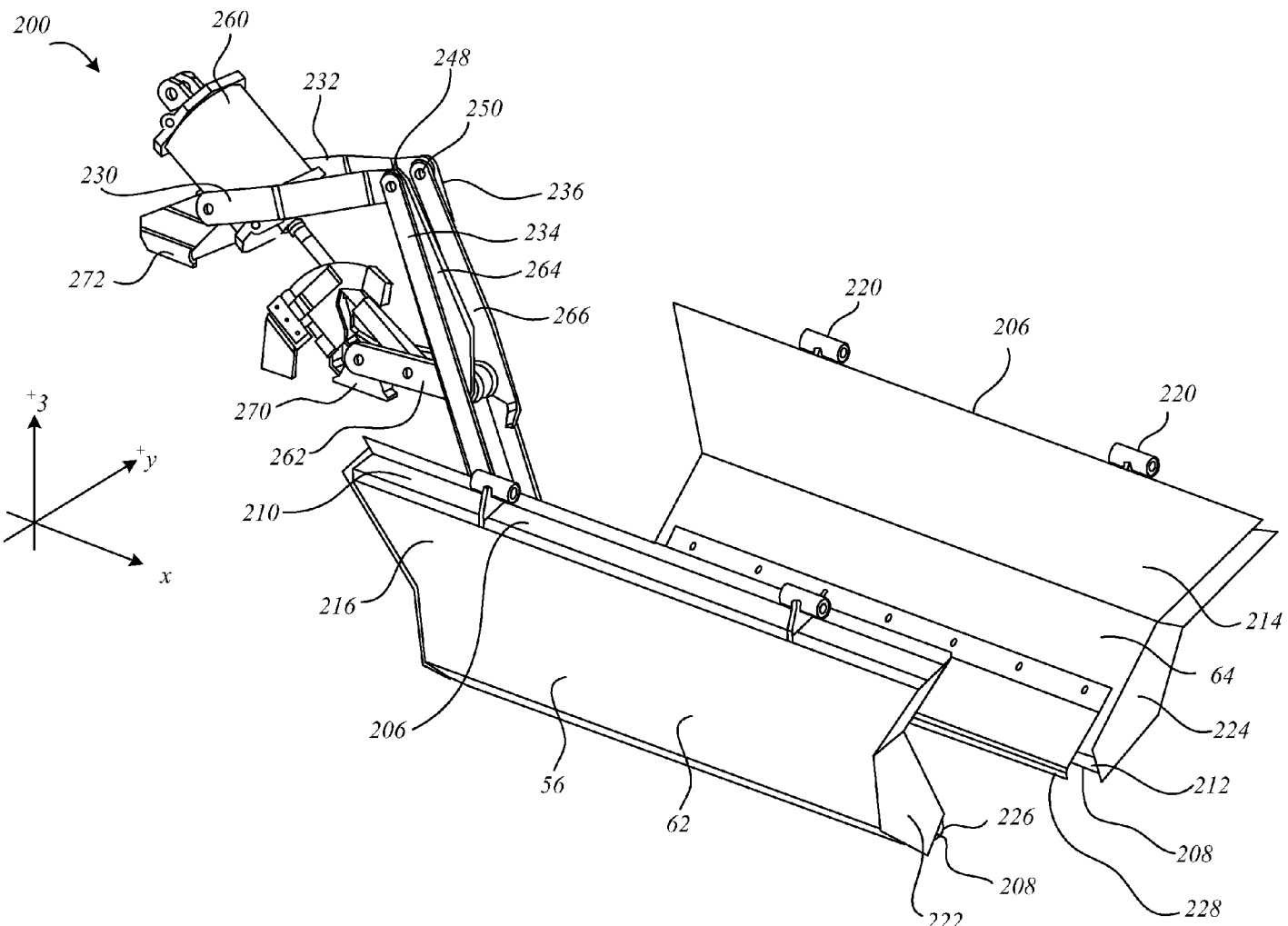
FIG. 4*a* is a isometric view of a portion of the door opening mechanism for the railroad car of FIG. 1 in a fully open position.
Figure 4B:
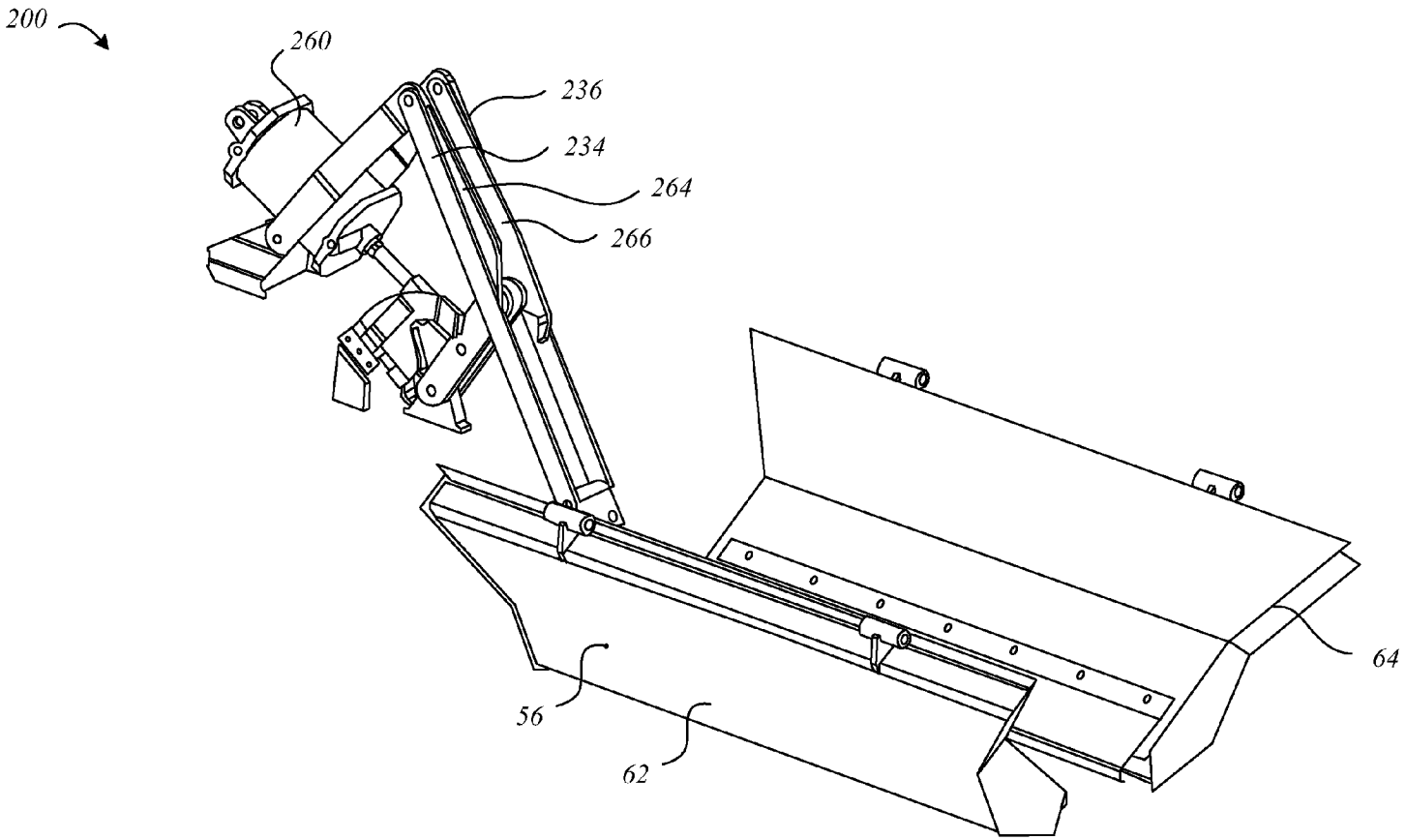
FIG. 4*b* is an isometric view of a portion of the door opening mechanism for the railroad car of FIG. 1 in an intermediate position.

As may be noted, the line of action of drag links 234, 236 has a predominant component that is substantially parallel to plane $P_{48}$. Expressed differently, at some point during mid-stroke, the line of action will be at least instantaneously parallel to plane $P_{48}$. Finally, it may be noted that rather than placing actuator 260 on shear plate 76, and orienting actuator 260 such that its longitudinal axis (i.e., the working axis or axis of reciprocation of the actuator), that actuator is itself raised upwardly from the shear plate and oriented to work along a line of action that is tilted downward and longitudinally inboard, the angle of tilt being identified as $\alpha_{260}$. This angle of inclination lies in the range from horizontal to the angle of inclination of end slope sheet 48, identified in FIG. 5*c* as $\alpha_{48}$. Placing the mounts and pivot points under the apparatus, raising the actuator cylinder, orienting it on an incline, and making the line of action or the zone swept by the draglinks in the progressions of FIGS. 4*a*, 4*b* and 4*c* (or 5*a*, 5*b* and 5*c*) tend to correspond to a displacement substantially or predominantly parallel to plane $P_{48}$, all aid in providing a more compact installation, in particular one that is longitudinally short as may suit the short distance from the truck center to the striker. It is also an installation that may tend to leave space for other car systems, such as the brake system.

This arrangement may be thought of in terms of a four bar, or multi-bar, linkage. The first bar of the linkage may be thought of as being the underframe, and structure rigidly mounted to the underframe. This is the datum, or frame of reference member of the linkage. The second member or linkage component is the first pivot arm, 230 (or 232) having a fixed main pivot point, and an output distal pivot point constrained to move on a fixed radius about main pivot point $P_{230}$. The fourth component or element of the linkage is the second pivot arm, namely 62 or 64, each of which is a second lever or pivot arm mounted to a pivot axis fixed with respect to the first or datum link, and having a distal connection, in this case also a pivot connection, constrained to move in an arc of constant radius about the base pivot axis. The third linkage is the drag link. Although the drag link is made of two portions that are held together at yoke 238, the geometric symmetry of the assembly constrains both the upper portion of the drag link, (i.e., drag link 234, 236) and the lower portions, (i.e., slave links 240, 242) to be co-planar during closing of the doors. In any case, the single input of the actuator cylinder acting through the over-center links against the first pivot arm (at the distal pivot connection) produces a unique output geometry such that position of the elements is determinate as if it were a four bar linkage.

Figure 5C:
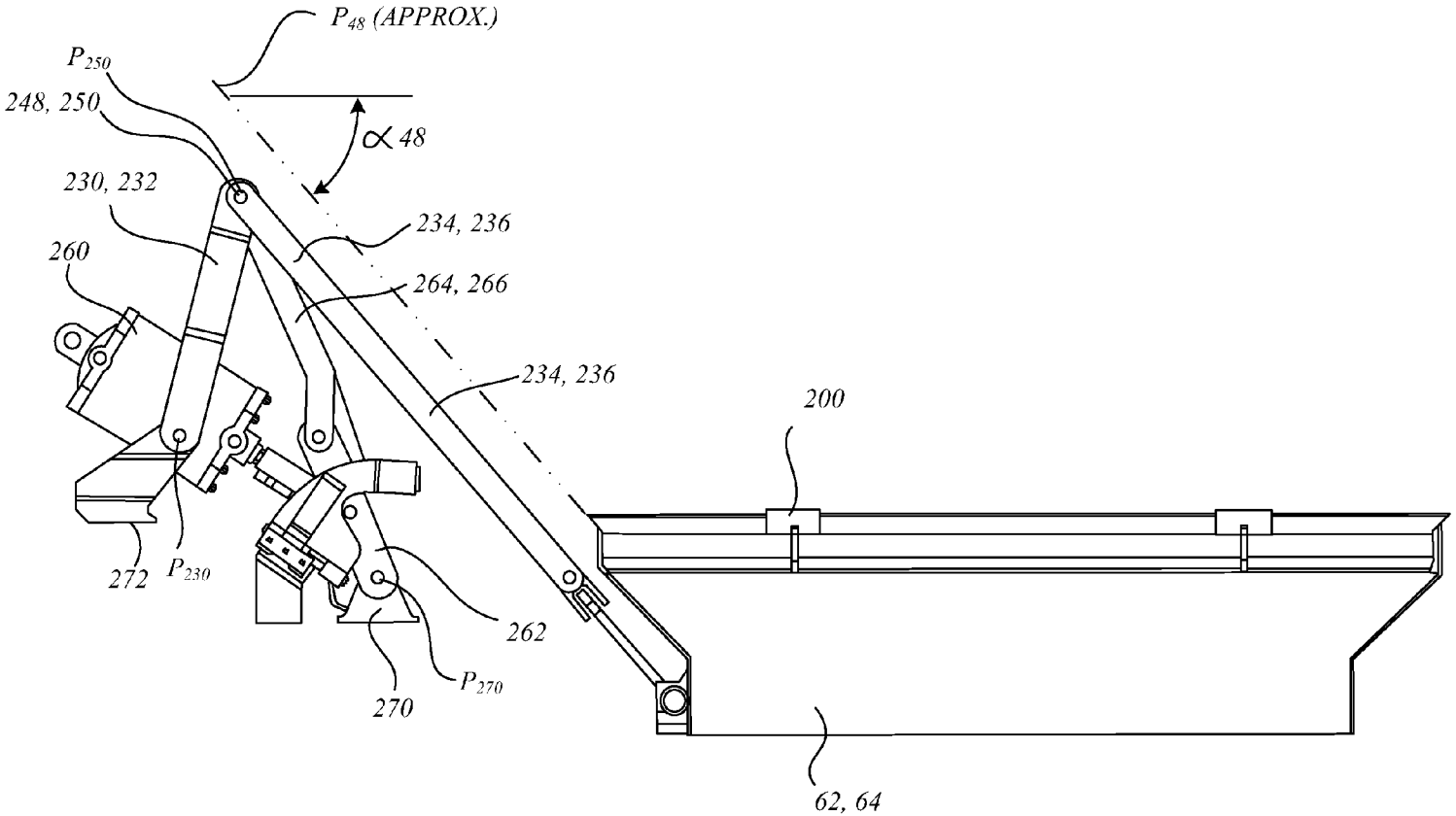
FIG. 5*c* is a side view of the door opening mechanism of FIG. 4*c;*
Figure 6C:
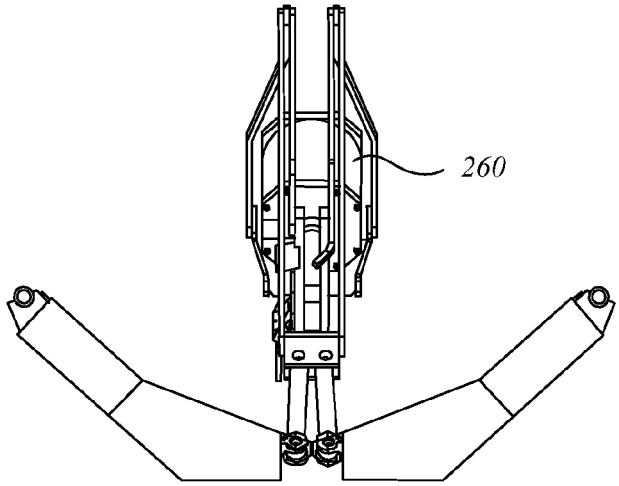
FIG. 6*c* is an end view of the door opening mechanism of FIG. 4*c;*
Figure 6B:
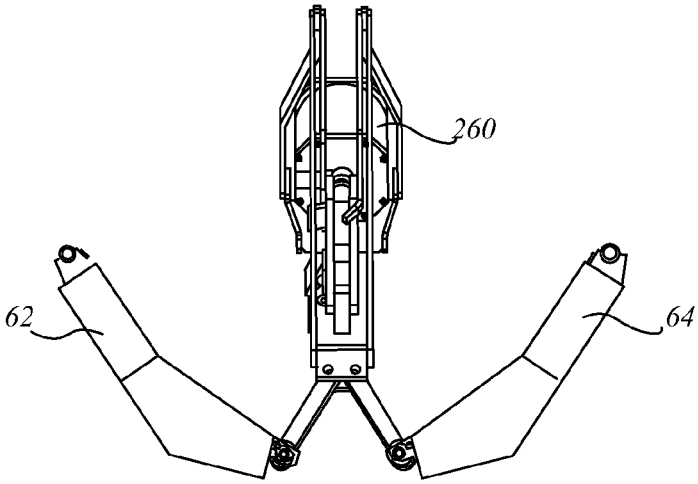
FIG. 6*b* is an end view of the door opening mechanism of FIG. 4*b*.

When the door opening apparatus is retracted to the position shown in FIGS. 4*c*, 5*c* and 6*c*, driven primary pivot arms and the over-center links are driven to a slightly overcenter relationship such that the pivot connection between the primary pivot arms and the overcenter arms lies below a line drawn from the primary pivot axis and the over-center link output connection as axis $P_{250}$. In this condition tensile force on drag links 234 and 236 (as from weight placed on doors 62, 64, for example) will tend to urge the main driven pivot arms, namely lever 262, counter-clockwise as viewed in FIG. 4*c*. Motion in this direction is prevented by the over center stop, 268, thereby defining a first lock that prevents inadvertent opening of doors 62, 64 from moving to the open position when actuator 260 is dormant, i.e., inactive. This first lock is released by reversing actuator 260 to open the doors.

Figure 6A:
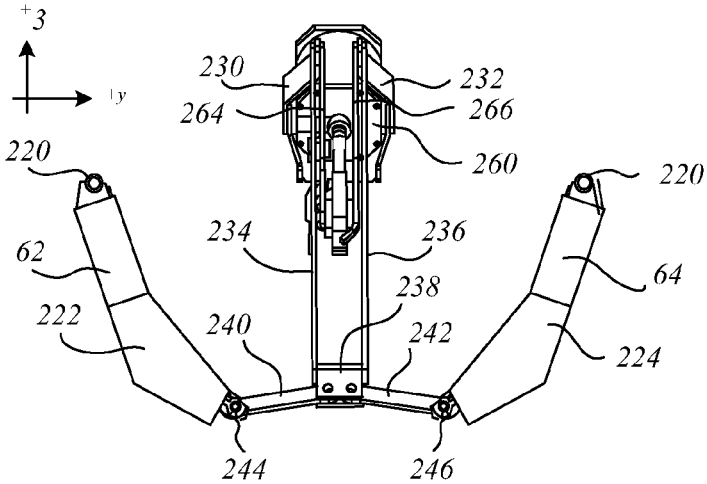
FIG. 6*a* is an end view of the door opening mechanism of FIG. 4*a;*

Car 20 has a secondary door mechanism, or secondary latching system, identified generally as 300. This secondary latch system, and, indeed, the door closure linkage apparatus of FIGS. 7*a*-7*e*, are slightly different from those shown in FIGS. 4*a*, 5*a*, and 6*a*. In latching system 300 there is a latch assembly 302, shown in FIGS. 7*a* and 7*b*. Assembly 302 includes a first member, or main member, or plate 304, which performs the function of a body or armature or spider that ties the other various physical elements of the assembly together. Along one edge plate 304 has physical motion constraint fittings, identified as hinge fittings 306, that limit plate 304 (and assembly 302 more generally) to a single degree of freedom, that single degree of freedom limiting plate 304 to motion of any point to motion in a plane perpendicular to the hinge axis, and in particular to pivotal motion in that plane about that axis. To the extent that the hinge axis is substantially or predominantly parallel to the axis of reciprocation of pneumatic actuator 260, that motion can be said to be sideways, or predominantly transverse of crosswise to that direction of reciprocation.

Plate 304 has a portion or finger, or arm member 308 extending away from the hinge. In this case, arm member 308 extends arcuately away, and has a bent termination, or end, or lip, or tip, indicated at 310. Another member 312 in the form of a block is mounted, e.g., welded, at the distal end of arm member 308. Member 312 has the same general shape, a dogleg bend, as tip 310. Member 312 has a first, generally inwardly (i.e., away from the tip) facing surface 314 that defines an abutment 316. Member 312 also has an oblique surface 318 that defines a wear or cam surface, which may be termed a reset cam, or return cam.

Another member 320, which may have the form of a plate or block, is welded to the major portion of the body of plate 304 relatively close to the hinge axis. The axially foremost face of member 322 is relieved—i.e., it does not define a face in a plane perpendicular to the hinge axis—or to the axis of reciprocation of the pneumatic actuator clevis. This face may be arcuate or chamfered, and so defines a first or deflection cam 324. That is, as installed, it lies in the path of actuator clevis 330. When the leading corner of clevis 330 encounters cam 324, plate 304 will tend to be urged to rotate, i.e., pivot, about its axis in the clockwise direction as viewed looking from actuator 260 toward hopper 52. Assembly 302 also includes a motion resisting, or return biasing member in the form of a spring, identified as leaf spring 326 that is anchored at the proximal end to stationary structure of the secondary lock footing, or base, 328 which is welded to shear plate 76. The footprint of base 328 against shear plate 76 is planar. The hinge axis is inclined relative to the plane as shown, the angle of inclination being substantially similar to, and possibly the same as, the mid-stroke angle of inclination of actuator 260 (which, itself, varies slightly during operation). The distal end of spring 326 bears against plate 304 distant from the hinge. Finally, assembly 302 includes reaction force transmission members 332, 334 in the form of welded flat bars that bear against, i.e., abut, the longitudinally outboard face of mounting fitting 270 when the latch is in the engaged position.

In operation, as actuator 260 works, lost motion is taken up in slot 336 of the distal or forward end 338 of the reciprocating actuator ram. Eventually the end of slot 336 engages a pivot pin 340 of bell crank arm 342 and causes driven member 344 (analogous to driven member 262), causing it to rotate counterclockwise as viewed in FIG. 7*a*. This forces push rods 346, 348 (analogous to push rods 264, 266) to act against connections 248, 250, and hence to force drag links 234, 236 along their retracting path. Since 262, 264, 230 and the car body form a four bar linkage, the output path of connections 248, 250 is determinate and unique.

Figure 7B:
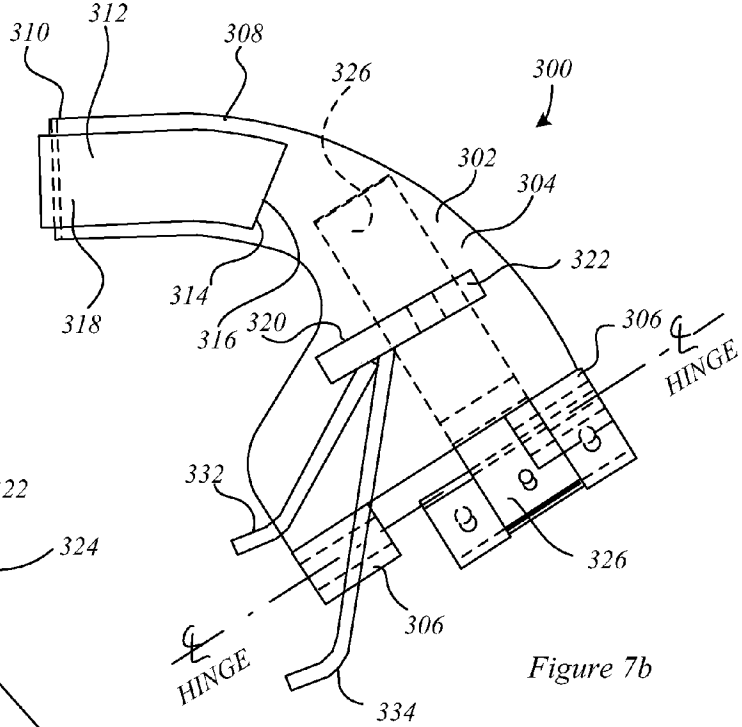
FIG. 7*b* is a plan view of the mechanism of FIG. 7*a;*
Figure 7A:
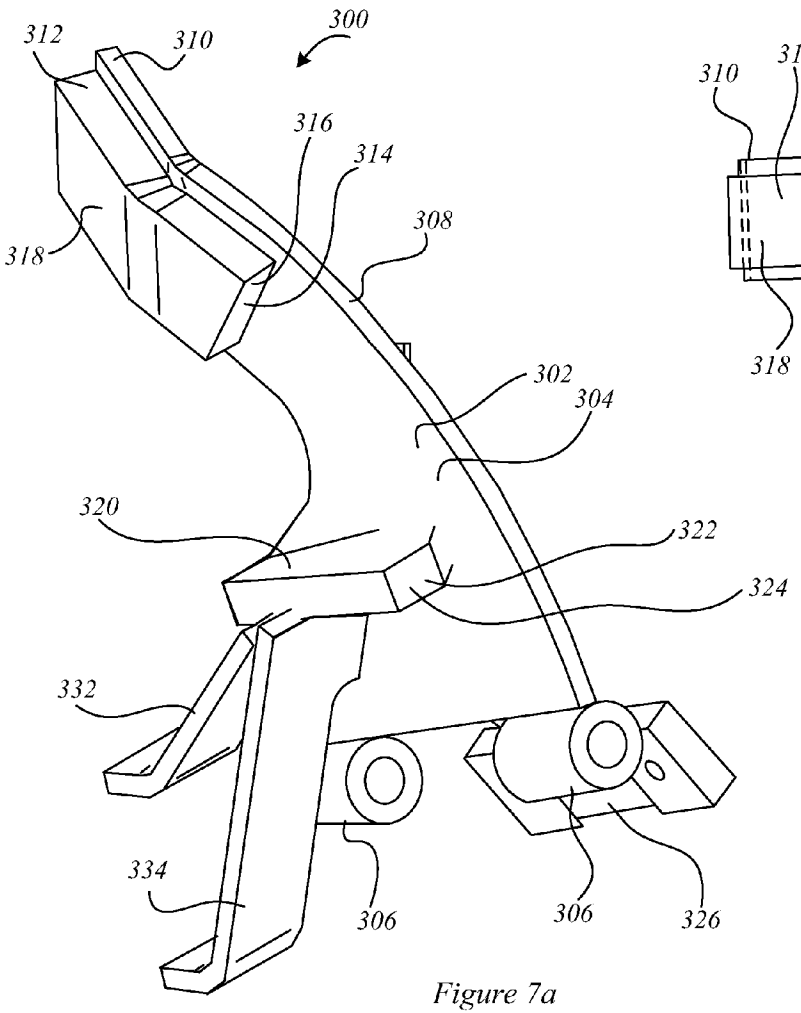
FIG. 7*a* is a perspective view of a secondary lock mechanism for the door opening mechanism of FIG. 4*a;*
Figure 7C:
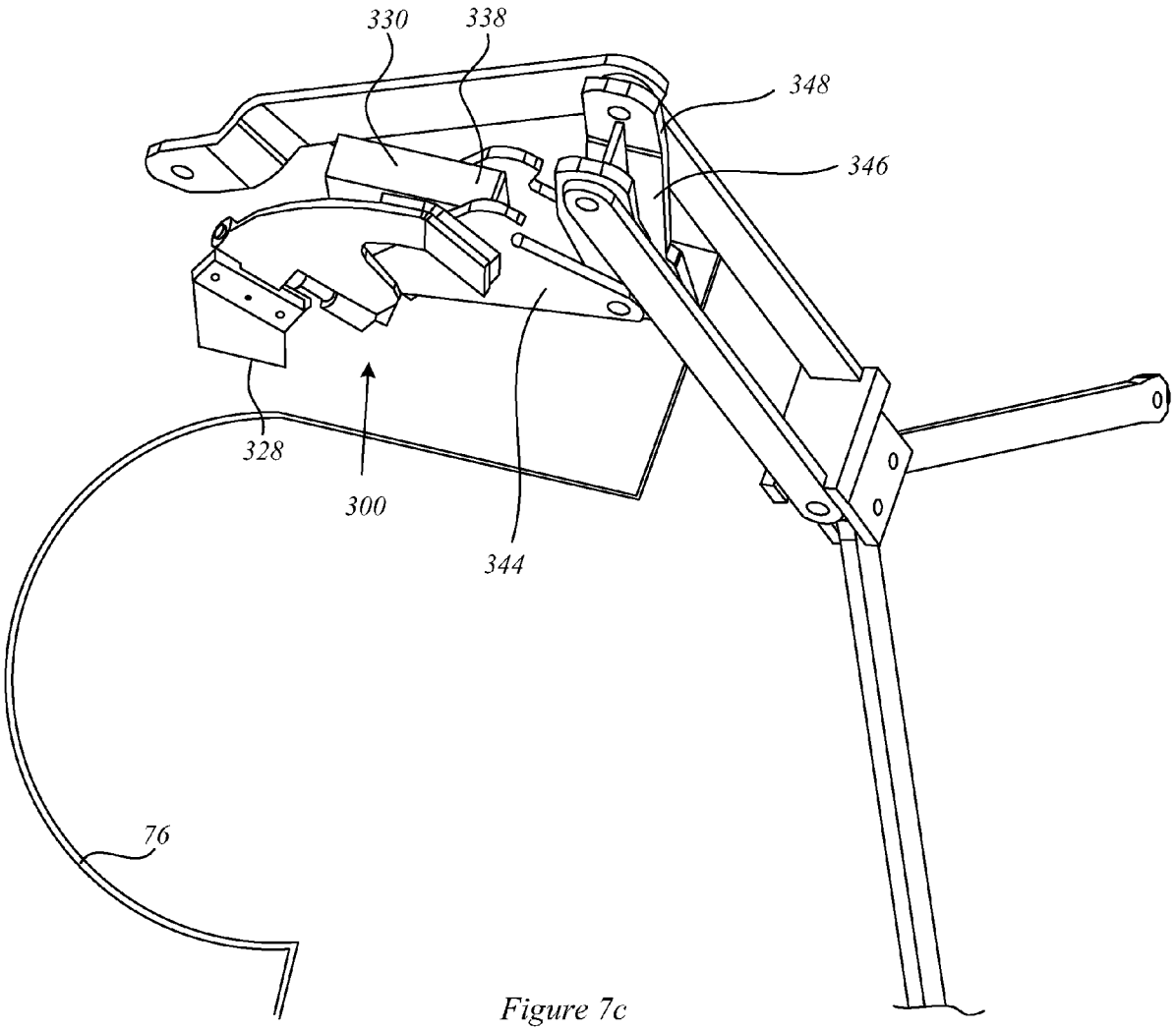
FIG. 7*c* is a perspective view of the mechanism of FIG. 7*a* when the door are open.
Figure 7D:
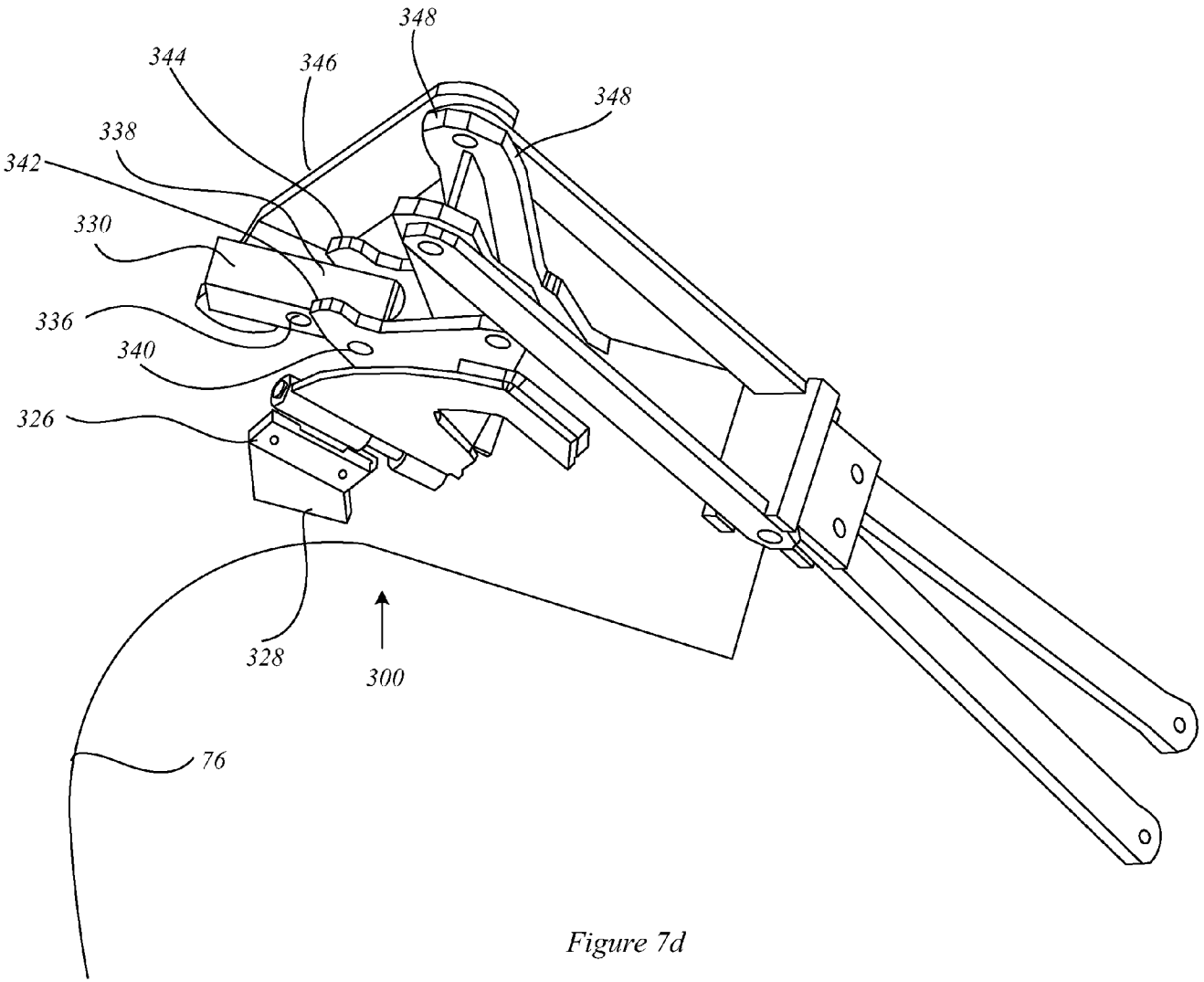
FIG. 7*d* is a view similar to FIG. 7*c*, of the mechanism of FIG. 7*a* in a deflected condition.
Figure 7E:
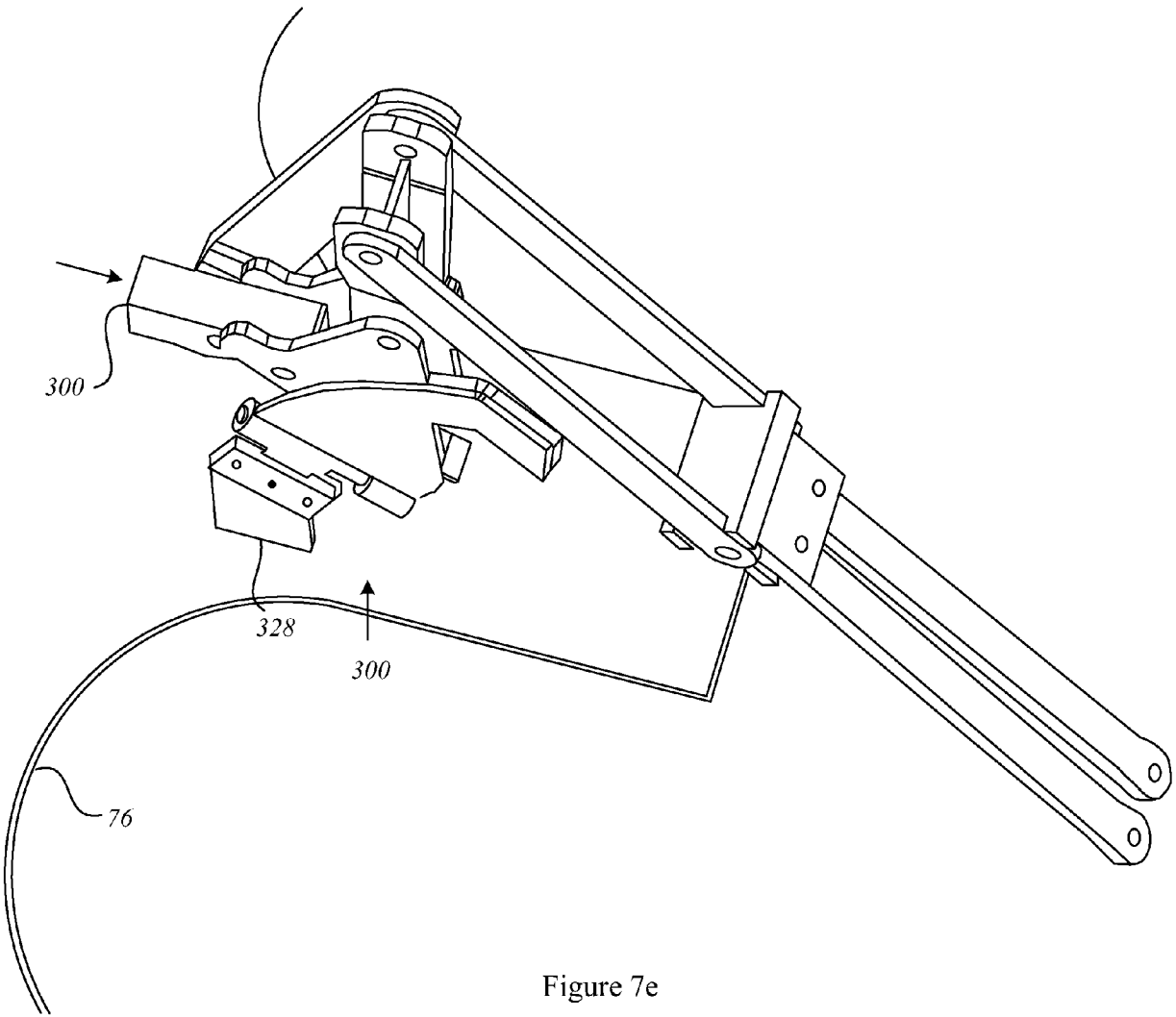
FIG. 7*e* is a perspective view of the mechanism of FIG. 7*a* in a locked position.

While this happens, clevis 338 keeps moving rearward to engage reset cam surface 318, with the effect that assembly 302 is urged to rotate out of the way, against the resistance of spring 326 (FIG. 7*d*). Eventually the trailing portion of clevis 338 clears cam 324, and soon thereafter the most longitudinally inboard edge of driven member 344 clears abutment 316. Assembly 302 then moves under the influence of spring 326 into the locked position shown in FIG. 7*e*. In this locked position, any moment tending to pivot driven member 344 clockwise is reacted not by the hinge fittings, but rather by the reinforcements, namely members 332, 334. In this locked position driven member 344 and push rods 346, 348 are drawn to, and locked in, their over center position.

When the doors are to be released, actuator 260 moves in the opposite direction. The lost motion of the length of slot 336 reverses, such that the end of clevis 338 bears against the release cam, namely cam surface 324, which causes plate 304 to pivot away, and thus disengages abutment 316, moving it out of the path of driven member 262 against which it would otherwise abut. The outboard end of slot 336 then engages pin 340, releasing the overcenter hold of driven member 344, and permitting the doors to open under the influence of gravity.

Figure 4C:
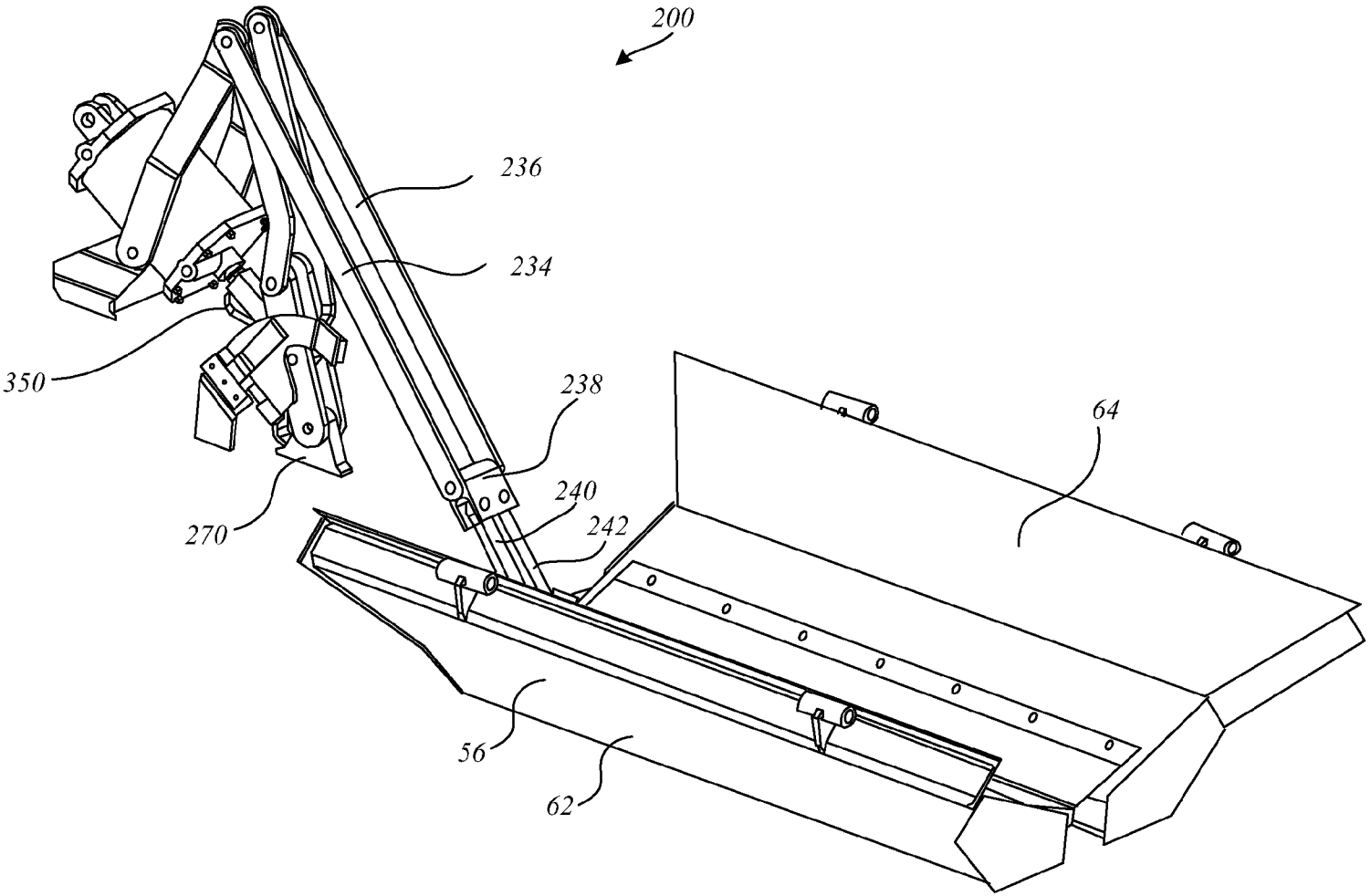
FIG. 4*c* is an isometric view of a portion of the door opening mechanism for the railroad car of FIG. 1 in a fully closed position.

The cams need not necessarily be on the plate, i.e., the latch body, but could be on the clevis, as shown at 350 in FIG. 4*c*. That is, it is to some extent arbitrary which part is identified as the cam, and which part is identified as the cam follower. The point is that the parts mutually engage such that the one intercepts the other during motion of the actuator cylinder to trip the door opening condition, with the result that the secondary latch is urged to deflect out of the way sideways. In the other direction, of course, the abutment relationship of items 262 and 316 prevents the doors from opening. The apparatus of FIG. 4*c* works in substantially the same way, and combines both arms of the bell crank driven member 344 into a single driven lever, namely lever 262.

In summary, car 20 has a first lock, the over center lock, operable to prevent movement of the door from the closed position to the open position when the door actuator is inactive. Car 20 also has a second lock, symbolized by latching system 300, operable to prevent movement of the door from the closed position to the open position when the door actuator is inactive if the first lock should fail. The second lock is movable between an engaged position in which it prevents movement of the door to the open position thereof. In moving between the engaged and disengaged positions, the second lock has a displacement that is predominantly crosswise to the first direction of the reciprocation of the door actuator. Actuator 260 is positioned to reciprocate in the central lengthwise-vertical plane of car 20. Latching system 300 is movable predominantly transverse to the central lengthwise-vertical plane as it pivots in a circumferential direction between the engaged and disengaged positions. The hinge axis lies parallel to the lengthwise-vertical plane, and the second lock pivots circumferentially. The second lock is biased toward the engaged position. The lock mechanism can be thought of as having a first fitting, a second fitting and a third fitting. The first fitting is the mounting, 238 by which to connect the lock mechanism to the datum structure. The second fitting is one of a cam or a cam follower for co-operation with a member of the door actuating transmission. The third fitting is the abutment, i.e., 316, that co-operates with a mating part of the door actuating transmission, in this case the side of lever 262. The third fitting is movable between a first position and a second position, in the first position the abutment being presented to obstruct motion of the mating fitting of the door actuating transmission and thereby to prevent the door from moving to an open position thereof. The second fitting is movable between a first position and a second position, in the first position thereof the second fitting being positioned to intercept the member of the door actuating transmission and to be deflected away from the first position toward the second position thereby. The first fitting has a first degree of freedom of motion permitting the first and second fittings to move between their respective first and second positions. The degree of freedom constrains the third fitting to motion predominantly crosswise to the axial direction. The bias member is a spring having a first end and a second end, the first end being mounted to bear against the body of the lock mechanism, the second end having a foot for reaction against the datum structure, namely shear plate 76. The first degree of freedom of motion is an angular degree of freedom, and is predominantly crosswise circumferential motion. The axis of rotation is the hinge axis, which is substantially parallel to the axial direction of the door actuating transmission.

Various embodiments have been described in detail. Since changes in and or additions to the above-described examples may be made without departing from the nature, spirit or scope of the invention, the invention is not to be limited to those details.

We claim:

1. A railroad freight car comprising:

a car body for carriage by railroad car trucks in rolling motion along railroad car tracks;

said car body having a first end and a second end;

said car body including a first draft sill mounted at said first end of said car body;

said car body having a first center plate for mounting atop one of the rail road car trucks, said center plate defining a truck center of said railroad freight car;

said first draft sill having a distal end longitudinally outboard of said center plate, and a striker mounted at said distal end;

said first draft sill having a draft pocket defined therein in which to accommodate draft gear;

said draft sill having a top cover above said draft pocket;

said top cover having an opening defined therein above said draft pocket;

said draft sill has front and rear draft stops mounted therein, said front draft stops being mounted closer to the striker than are the rear draft stops; and a portion of the rear draft stops extends longitudinally inboard of the truck center.

2. The railroad freight car of claim 1 wherein:

said opening defined in said top cover of said draft sill accommodates protrusion of an end of the draft gear upwardly therethrough during installation of said draft gear; and said car includes a removable cover plate mountable to close said opening defined in said top cover.

3. The railroad freight car of claim 1 wherein said draft sill has an underside opening by which to introduce draft gear into said draft pocket, and a removable draft gear carrier plate mountable to said draft sill to close said underside opening when the draft gear is mounted within said draft pocket.

4. The railroad freight car of claim 1 wherein said draft sill has front and rear draft stops mounted therein, said front draft stops being mounted closer to the striker than the rear draft stops; and a portion of the rear draft stops extending longitudinally inboard of the truck center.

5. The railroad freight car of claim 1 wherein said draft sill is a fabricated draft sill of welded construction having said top cover, first and second side webs, and a bottom flange, and said freight car includes an end section shear plate extending cross-wise across said car, said top cover of said draft sill being defined by a portion of said end section shear plate

6. The railroad freight car of claim 1 wherein said rail road car has a draft sill length measured from said truck center to said striker of less than 50 inches.

7. The railroad freight car of claim 1 wherein said draft sill length is in the range of 36 to 40".

8. The railroad freight car of claim 1 wherein:

said draft sill is a fabricated draft sill of welded construction having said top cover, first and second side webs, and a bottom flange, said freight car includes an end section shear plate extending cross-wise across said car, said top cover of said draft sill being defined by a portion of said end section shear plate;

said opening defined in said top cover of said draft sill accommodates protrusion of an end of the draft gear upwardly therethrough during installation of said draft gear;

said car includes a removable cover plate mountable to close said opening defined in said top cover;

said draft sill has an underside opening by which to introduce draft gear into said draft pocket, and a removable draft gear carrier plate mountable to said draft sill to close said underside opening when the draft gear is mounted within said draft pocket;

said side webs each have respective distal end portions adjacent to said striker;

said distal end portions of said side webs each have respective apertures formed therein;

said draft sill has a removable coupler carrier mounted longitudinally inboard of said striker said coupler carrier being movable cross-wise relative to said webs through said apertures formed in said distal end portions of said draft sill webs.

9. A method of installation of a draft gear in a railroad car draft sill, the railroad car being a railroad freight car having: a car body for carriage by railroad car trucks in rolling motion along railroad car tracks; said car body having a first end and a second end; said car body including a first draft sill mounted at said first end of said car body; said car body having a first center plate for mounting atop one of the rail road car trucks, said center plate defining a truck center of said railroad freight car; said first draft sill having a distal end longitudinally outboard of said center plate, and a striker mounted at said distal end; said first draft sill having a draft pocket defined therein in which to accommodate draft gear; said draft sill having a top cover above said draft pocket; and said top cover having an opening defined therein above said draft pocket, the method commencing with the railroad freight car being in a condition where said aperture is open, wherein said method includes:

introducing a first end of the draft gear into the draft pocket with a second end of the draft gear tilted downward away therefrom;

moving the first end of the draft gear to a position in which it protrudes upwardly through the opening in the top cover; and moving the second end of the draft gear into the draft sill while moving the first end of the draft gear toward the truck center such that the first end of the draft gear ceases to protrude through said opening in said top cover.

10. The method of claim 9 wherein said method includes placing a cover plate over the opening in the top cover after the draft gear is in position in the draft pocket.

11. The method of claim 10 wherein the draft pocket is initially open from the bottom and the method includes installing a draft gear carrier plate on an underside of the draft pocket to enclose the draft gear therein.

12. The method of claim 9 wherein the car has a removable coupler carrier for mounting adjacent to the striker and longitudinally inboard thereof, and the method includes verifying that the coupler carrier is removed before inserting the draft gear, establishing the draft gear in place with a draft gear yoke mounted thereto, and positioning the coupler carrier in place once the draft gear is in position inside the draft pocket.

13. The method of claim 12 wherein the method includes registering a coupler shank with the yoke and placing a coupler key to connect the coupler shank and the yoke, and, as so installed, said coupler shank being positioned above the coupler carrier.

14. The method of claim 9 wherein the draft pocket is initially open from the bottom, the car has a removable coupler carrier for mounting adjacent to the striker and longitudinally inboard thereof and said method includes:

verifying that the coupler carrier is removed before inserting the draft gear;

establishing the draft gear in place with a draft gear yoke mounted thereto;

placing a cover plate over the opening in the top cover after the draft gear is in position in the draft pocket;

installing a draft gear carrier plate on an underside of the draft pocket to enclose the draft gear therein;

positioning the coupler carrier in place once the draft gear is in position inside the draft pocket; and registering a coupler shank with the yoke and placing a coupler key to connect the coupler shank and the yoke, and, as so installed, said coupler shank being positioned above the coupler carrier.

15. A railroad freight car said railroad freight car comprising:

a freight car body for carrying lading, said body being mounted on railroad car trucks for rolling motion in a longitudinal direction along railroad tracks;

said car body including a draft sill having a draft gear pocket for accommodating draft gear, and a shear plate overlying said draft sill and functioning as an upper flange of said draft sill;

said draft sill having an inboard portion located proximate to a truck center of one of said trucks, and an outboard end terminating distant from the truck center at a striker;

said draft sill having an underside and an access opening formed in said underside to admit entry of draft gear into said draft gear pocket from below;

said car having a draft gear carrier plate, said carrier plate being mounted to said underside of said draft sill beneath said draft gear pocket, and said carrier plate being removable to permit installation of the draft gear into said draft gear pocket;

said car body having an aperture formed in said shear plate over an inboard end region of the draft sill, said aperture permitting a portion of said draft gear to protrude therethrough during installation in said draft gear pocket, said draft sill has a centerplate centered on said truck center, rear draft stops are welded within said draft sill, and at least a portion of each of said rear draft stops extends longitudinally inboard of the truck center.

16. The railroad freight car of claim 15, and further comprising a cover plate for said aperture of said shear plate, said cover plate being removable to permit installation of said draft gear.

17. The railroad freight car of claim 15, wherein:

said draft sill has a pair of vertically oriented, longitudinally running spaced apart side webs;

said webs each have a downwardly extending chin next to said striker;

said chins have respective first and second apertures formed therein, said apertures being located behind said striker;

said first and second apertures defining said draft gear coupler carrier seat and said retainer is a shaft that is movable sideways, and, when installed, extends across said draft sill between said first and second apertures in said draft sill side webs; and said coupler carrier having first and second ends that, when installed, locate in said first and second apertures respectively.

18. The railroad freight car of claim 15 wherein one of:

(a) said freight car has a truck center to striker draft sill length of less than 50 inches; and (b) said freight car has a truck center to coupler pulling face length of less than 65 inches when the draft gear is fully extended in draft.

19. The railroad freight car of claim 18 wherein one of:

(a) said freight car has a truck center to striker draft sill length of about 38 inches (+/−2"); and (b) said freight car has a truck center to coupler pulling face length of about 53 inches (+/−2") when the draft gear is fully extended in draft.

20. The railroad freight car of claim 15 including said draft gear, and wherein said draft gear is short travel draft gear having a deflection of less then 3 inches to solid.

21. The railroad freight car of claim 15, including the draft gear, and wherein:

said freight car has a truck center to striker draft sill length of less than 50 inches; and said freight car has a truck center to coupler pulling face length of less than 65 inches when the draft gear is fully extended in draft; and said draft gear, and wherein said draft gear is short travel draft gear having a deflection of less then 3 inches to solid.

22. The railroad freight car of claim 15 wherein:

said railroad freight car is a railroad hopper car for carrying particulate material, said hopper car comprising:

a hopper;

first and second end sections for carriage by respective first and second ones of said rail road car trucks;

said hopper being suspended between said first and second end sections, said hopper having a discharge section through which to release lading, and first and second end slope sheets slanted downward and longitudinally inboard from said first and second end sections to feed said discharge section;

said first end section including said draft sill and said shear plate;

said first end section having a main bolster extending cross-wise to either side of said draft sill, said shear plate being mounted to overlie said draft sill and said main bolster, said shear plate extending lengthwise along said draft sill and cross-wise from side to side of said hopper car;

said first end slope sheet of said hopper overhanging said shear plate of said first end section; and said hopper car being free of primary structure directly above said aperture of said shear plate under said overhang of said first end slope sheet of said hopper.

23. The railroad freight car of claim 15 comprising a cover plate for said aperture of said shear plate, said cover plate being removable to permit installation of said draft gear.

24. The railroad freight car of claim 15 wherein said draft sill has a pair of vertically oriented, longitudinally running spaced apart side webs; said webs have a greater depth of section adjacent to said striker than elsewhere, said webs have respective first and second apertures formed therein, said first and second apertures defining said draft gear coupler carrier seat, and said retainer is a sideways slidable shaft that is movable to extend across said draft sill between said first and second apertures in said draft sill side webs.

25. The railroad freight car of claim 15 wherein:

said draft sill has a pair of vertically oriented, longitudinally running spaced apart side webs;

said webs each have a downwardly extending chin next to said striker;

said chins have respective first and second apertures formed therein, said apertures being located behind said striker;

said first and second apertures defining said draft gear coupler carrier seat and said retainer is a shaft that is movable sideways to extend across said draft sill between said first and second apertures in said draft sill side webs; and said coupler carrier having first and second ends that, when installed, locate in said first and second apertures respectively.

26. The railroad freight car of claim 15, including the draft gear, and wherein:

said freight car has a truck center to striker draft sill length of less than 50 inches; and said freight car has a truck center to coupler pulling face length of less than 65 inches when the draft gear is fully extended in draft; and said draft gear, and wherein said draft gear is short travel draft gear having a deflection of less then 3 inches to solid.

27. The railroad freight car of claim 15 wherein said railroad freight car is a railroad hopper car for carrying particulate material; said hopper car has a hopper; and said first and second end sections for carriage by respective first and second ones of said rail road car trucks;

said hopper being suspended between said first and second end sections, said hopper having a discharge section through which to release lading, and first and second end slope sheets slanted downward and longitudinally inboard from said first and second end sections to feed said discharge section;

said first end section including said draft sill and said shear plate;

said first end section having a main bolster extending crosswise to either side of said draft sill, said shear plate being mounted to overlie said draft sill and said main bolster, said shear plate extending lengthwise along said draft sill and cross-wise from side to side of said hopper car;

said first end slope sheet of said hopper overhanging said shear plate of said first end section;

a cover plate for said aperture of said shear plate, said cover plate being removable to permit installation of said draft gear;

said hopper car being free of primary structure directly above said aperture of said shear plate under said overhang of said first slope sheet of said hopper;

said draft sill has a pair of vertically oriented, longitudinally running spaced apart side webs; said webs have a greater depth of section adjacent to said striker than elsewhere, said webs have respective first and second apertures formed therein, said first and second apertures defining said draft gear coupler carrier seat, and said coupler carrier seat is a sideways slidable shaft that is movable to extend across said draft sill between said first and second apertures in said draft sill side webs;

said draft sill has a centerplate centered on said truck center, rear draft stops are welded within said draft sill, and at least a portion of each of said rear draft stops extends longitudinally inboard of the truck center;

said freight car has a truck center to striker draft sill length of less than 50 inches; and said freight car has a truck center to coupler pulling face length of less than 65 inches when the draft gear is fully extended in draft; and said draft gear, and wherein said draft gear is short travel draft gear having a deflection of less then 3 inches to solid.

* * * * *